US007600753B2

(12) United States Patent
Katayama

(10) Patent No.: US 7,600,753 B2
(45) Date of Patent: Oct. 13, 2009

(54) RECORDING APPARATUS AND MEDIUM TRANSPORTING METHOD

(75) Inventor: Hiroshi Katayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 11/897,309

(22) Filed: Aug. 30, 2007

(65) Prior Publication Data

US 2008/0067739 A1 Mar. 20, 2008

(30) Foreign Application Priority Data

Aug. 31, 2006 (JP) ..... 2006-236906

(51) Int. Cl.
*B65H 7/02* (2006.01)

(52) U.S. Cl. ..... 271/265.01; 271/266

(58) Field of Classification Search ..... 271/265.01, 271/266, 258.01

See application file for complete search history.

(56) References Cited

U.S. PATENT DOCUMENTS 5,423,527 A * 6/1995 Tranquilla ..... 271/10.02
5,575,466 A * 11/1996 Tranquilla ..... 271/10.03
5,692,742 A * 12/1997 Tranquilla ..... 271/10.03
5,848,784 A * 12/1998 Tranquilla ..... 271/10.03
6,199,854 B1 * 3/2001 Tranquilla et al. ..... 271/34
6,554,275 B1 * 4/2003 Tranquilla ..... 271/259
6,702,274 B1 3/2004 Otsuka et al.
6,978,992 B2 12/2005 Otsuka et al.

FOREIGN PATENT DOCUMENTS

JP 2001-039552 A 2/2001
JP 2005-096450 4/2005
JP 2006-036490 A 2/2006

* cited by examiner

*Primary Examiner*—David H Bollinger
(74) *Attorney, Agent, or Firm*—Nutter McClennen & Fish LLP; John J. Penny, Jr.

(57) ABSTRACT

A recording apparatus includes a first transporting device, a second transporting device, and a recording device which performs recording on the medium transported by the first and second transporting devices. The recording apparatus includes: a controller which determines one transporting device which is to be driven first according to a condition, determines the other transporting device which is to be subsequently driven and controls a startup timing of the other transporting device on the basis of a position parameter according to a driving amount of the one transporting device which is to be driven first.

8 Claims, 7 Drawing Sheets

RECORDING APPARATUS AND MEDIUM TRANSPORTING METHOD

CROSS REFERENCES TO RELATED APPLICATIONS

This application is based on Japanese Patent Application No. 2006-236906 filed on Aug. 31, 2007, in Japanese Patent Office, the entire content of which is hereby incorporated by reference.

BACKGROUND

1. Technical Field

The present invention relates to a recording apparatus for feeding and transporting a medium and recording an image on the transported medium, and a medium transporting method.

2. Related Art

In the related art, a printer which is a known example of a recording apparatus includes an auto sheet feeder (hereinafter, referred to as ASF) (for example, see JP-A-2005-96450). When a printing operation starts, a sheet of paper stored in the ASF is fed by the driving of the ASF and a front end of the sheet is automatically positioned at a printing start position.

The ASF starts the feeding of a next sheet after a previous sheet has been fed and ejected. However, in this feeding method, since the feeding operation of the next sheet starts after the previous sheet has been ejected, a gap between the previous sheet and the next sheet exists and a standby time is present between the completion of a printing operation of the previous sheet and the start of a printing operation of the next sheet. Accordingly, a printing time is increased.

In order to solve this problem, JP-A-2005-96450 discloses a printing apparatus (recording apparatus) for simultaneously performing an ejection operation of a previous sheet and a feeding operation of a next sheet to reduce a standby time between the completion of a printing operation of the previous sheet and the start of a printing operation of the next sheet. According to this printing apparatus, it is possible to improve printing throughput.

JP-A-2005-96450 discloses a configuration in which a plurality of transport rollers are driven by respective motors. The transport of the next sheet (a recording sheet of a next page) starts after a rear end of the previous sheet (a recording sheet of a current page) has passed through the transport roller such that the previous sheet and the next sheet are prevented from being double fed. That is, JP-A-2005-96450 discloses a configuration in which the driving of the transport roller is stopped until the previous sheet has been transported to a position for preventing double feeding, and the transport roller is then driven. Thereafter, when the previous sheet is transported, the next sheet is transported by the same transport amount as the feed amount of the previous sheet.

However, JP-A-2005-96450 does not disclose detailed motor control for ensuring a gap exists between the previous sheet and the next sheet. The plurality of motors for separately driving the plurality of transport rollers need to be controlled to cooperate with one another in order to suitably transport the sheet. For example, in JP-A-2005-96450, the driving of the transport roller is stopped until the previous sheet has been transported to the position for preventing double feeding, and the transport roller is then driven. In this case, a motor (first motor) for driving an upstream transport roller (first transport roller) which is stopped until the transport of the next sheet starts and a motor (second motor) for driving a downstream transport roller (second transport roller) which transports the previous sheet to the position for preventing double feeding need to be controlled to cooperate with each other. In this case, the first motor is driven at a predetermined timing delayed from a driving start timing of the second motor.

When a sheet is transported in a state in which the sheet is nipped by the first transport roller and the second transport roller, if the start timings of the first motor and the second motor are identical to each other, excessive tension may occur in the nipped sheet such that the sheet is damaged. In order to solve this problem, the first motor is to be driven first and the second motor is driven at a predetermined timing delayed from the driving start timing of the first motor such that the sheet is loosely transported. When the plurality of transport rollers for transporting the sheet are controlled to cooperate with each other by the motors, which of the motors is to be driven first is determined according to a condition and a difference between the timings varies according to the condition. Thus, the control operation becomes complicated. Accordingly, there is a need for a motor control method capable of transporting a sheet by a relatively simple control even when any one of the first motor and the second motor is to be driven first according to the condition.

SUMMARY

An advantage of some aspects of the invention is that it provides a recording apparatus capable of suitably controlling transport of a medium and performing a relatively simple control, and a medium transporting method thereof.

According to an aspect of the invention, there is provided a recording apparatus including a first transporting device which transports a medium, a second transporting device which transports the medium at a position downstream of the first transporting device in a transporting direction, and a recording device which performs recording on the medium transported by the first and second transporting devices, the recording apparatus including: a controller which determines one transporting device which is to be driven first from among the first transporting device and the second transporting device according to a condition, determines the other transporting device which is to be subsequently driven and controls a startup timing of the other transporting device which is to be subsequently driven on the basis of a position parameter according to a driving amount of the one transporting device which is to be driven first.

By this configuration, of the first transporting device and the second transporting device, one transporting device which is to be driven first is determined according to the condition, the other transporting device which is to be subsequently driven is determined, and the startup timing of the other transporting device which is to be subsequently driven is controlled on the basis of the position parameter according to the driving amount of the other transporting device which is to be driven first. Regardless of which of the transporting devices is to be driven first according to the condition, it is possible to start the driving one transporting device at a predetermined timing according to the driving amount of the transporting device which is to be driven first. Accordingly, when the medium is transported by shifting the driving timings of the first and second transporting devices, it is possible to accurately control the transport of the medium by accurately shifting the driving timings.

In the recording apparatus according to the invention, the controller may start driving of the first transporting device and control the startup timing of the second transporting device which is to be subsequently driven on the basis of the position parameter according to the driving amount of the first transporting device if the one transporting device which is to be driven first is the first transporting device, and first start driving of the second transporting device and control the startup timing of the first transporting device which is to be subsequently driven on the basis of the position parameter according to the driving amount of the second transporting device if the one transporting device which is to be driven first is the second transporting device.

By this configuration, if the one transporting device which is to be driven first is the first transporting device, driving of the first transporting device starts and the startup timing of the second transporting device which is to be subsequently driven is controlled on the basis of the position parameter according to the driving amount of the first transporting device. In contrast, if the one transporting device which is to be driven first is the second transporting device, driving of the second transporting device starts and the startup timing of the first transporting device which is to be subsequently driven is controlled on the basis of the position parameter according to the driving amount of the second transporting device. Accordingly, regardless of which of the first and second transporting devices is to be driven first, only the driving sequences of the first transporting device and the second transporting are changed and the control contents are identical. Accordingly, the control contents of the first and second transporting devices are simple.

The recording apparatus according to the invention may further include a first driving source which drives the first transporting device; and a second driving source which drives the second transporting device, and the controller may determine one driving source which is to be driven first from among the first and second driving sources according to a condition and control a startup timing of the other driving source which is to be subsequently driven on the basis of a position parameter of the one driving source which is to be driven first.

By this configuration, of the first and second driving sources, the driving source which is to be driven first is determined according to the condition and the startup timing (driving start timing) of the other driving source which is to be subsequently driven is controlled on the basis of a position parameter of the one driving source which is to be driven first. Since the first transporting device and the second transporting device are driven by the respective driving sources, it is possible to improve precision of a control operation for shifting the driving timings. For example, a configuration in which the first and second transporting devices are driven by a common driving source and the driving timings thereof are shifted by an electronic clutch is possible. However, if the configuration in which the transporting devices are controlled by the respective driving sources is employed, it is possible to further improve precision of a control operation for shifting the driving timings.

In the recording apparatus according to the invention, the controller sets a standby amount indicated by a driving amount of the one driving source, which is to be driven first, indicating the startup timing of the other driving source which is to be subsequently driven according to the condition after starting driving of the one driving source which is to be driven first, and permits driving of the other driving source which is to be subsequently driven when the position parameter becomes equal to a standby end position determined by the standby amount.

By this configuration, the standby end position indicating the startup timing of the other driving source which is to be subsequently driven is set according to the condition after starting driving of the one driving source which is to be driven first. In addition, when the position parameter reaches a standby end position determined by the standby amount, the driving of the other driving source which is to be subsequently driven is permitted. Since the driving end position is set according to the condition, it is possible to suitably control the transport of the medium according to the condition.

In the recording apparatus according to the invention, the controller may substantially simultaneously start the driving of the first driving source and the second driving source when the standby amount is a setting value corresponding to zero.

By this configuration, when the standby amount is the setting value corresponding to zero, the driving of the first driving source and the second driving source substantially simultaneously starts. Accordingly, if the driving timings of the first and second driving sources are not desired to be shifted, the standby amount is set to the setting value corresponding to zero. The same control can be used when the driving sources are substantially simultaneously driven as well as when the startup timings are shifted. Accordingly, the control is relatively simple.

In the recording apparatus according to the invention, the controller may stop the standing by of the other driving source and start the driving of the other driving source which is to be subsequently driven when the one driving source which is to be driven first is stopped due to a factor other than an error before reaching the standby end position determined by the standby amount.

By this configuration, when the one driving source which is to be driven first is stopped due to the factor other than the error before reaching the standby end position, the standby of the other driving source is stopped and the driving of the other driving source which is to be subsequently driven starts. Accordingly, when the one driving source which is to be driven first is stopped due to the factor other than the error before reaching the standby end position, it is possible to avoid a problem that the driving source which is to be subsequently driven is not driven even when an error does not occur.

In the recording apparatus according to the invention, the controller may stop the standing by of the other driving source and may not drive the other driving source when the one driving source which is to be driven first is stopped due to an error before reaching the standby end position determined by the standby amount.

By this configuration, when the one driving source which is to be driven first is stopped due to the error before reaching the standby end position, the standby of the other driving source is stopped and the standby driving source is not driven. Accordingly, when the driving source which is to be driven first is stopped due to the error before reaching the standby end position, it is possible to avoid a problem that the driving which is to be subsequently driven is driven even when an error occurs.

In the recording apparatus according to the invention, the condition may be completion of a transporting operation for transporting the medium to at least the first and second transporting devices, a determining device which determines whether a transporting operation for transporting the medium to at least the first and second transporting devices has been performed or not may further be included, and the controller may determine the first transporting device as the transporting device which is to be driven first, determine the second transporting device as the transporting device which is to be subsequently driven, and start the driving of the first transporting device when the position parameter becomes equal to a predetermined value for giving looseness to a portion of the medium between engagement positions where the first transporting device and the second transporting device are engaged with the medium, if the determining device determines that the transporting operation for transporting the medium to at least the first and second transporting devices has been performed.

By this configuration, if it is determined that the transporting operation for transporting the medium to at least the first and second transporting devices is performed, the first transporting device is determined to the transporting device which is to be driven first, the second transporting device is determined to the transporting device which is to be subsequently driven, and the driving of the first transporting device starts when the position parameter reaches the predetermined value for giving looseness to the portion between the engagement positions where the first transporting device and the second transporting device are engaged with the medium. As a result, the medium is transported in a state in which looseness is given to the portion between the engagement positions where the first transporting device and the second transporting device are engaged with the medium. Accordingly, it is possible to prevent the medium from being transported in a state in which excessive tension is given.

In the recording apparatus according to the invention, the controller may control the driving of the first and second transporting devices such that a previous medium which is first transported is transported to at least the first and second transporting devices, the driving of the first transporting device pauses when the previous medium is transported to a predetermined position where the previous sheet cannot transported by the first transporting device, and the transport of a next medium using the first transporting device starts after a gap between the previous medium and the next medium becomes of a predetermined size, and, when the condition for driving the first and second transporting devices in order to increase the gap between the previous medium and the next medium is satisfied after the first transporting device has paused at the predetermined position, the second transporting device may be determined as the transporting device which is the driven first such that the driving of the second transporting device starts, and the driving of the first transporting device starts when the position parameter according to the driving amount of the second transporting device reaches a value corresponding to the gap.

By this configuration, the previous medium which is first transported is transported to at least the first and second transporting devices, and the driving of the first transporting device pauses when the previous medium is transported to the predetermined position where the previous sheet is not transported by the first transporting device. In addition, the driving of the second transporting device pauses by the stop of the first transporting device. When the condition for driving the first and second transporting devices in order to increase the gap between the previous medium and the next medium is satisfied after the first and second transporting devices pause, the controller determines the second transporting device to the transporting device which is the driven first such that the driving of the second transporting device starts, and the driving of the first transporting device starts when the position parameter according to the driving amount of the second transporting device reaches the value corresponding to the gap. As a result, the transport of the next medium using the first transporting device starts after the driving of the second transporting device starts and then the gap between the previous medium and the next medium becomes the predetermined distance. Accordingly, it is possible to ensure the necessary gap between the previous medium and the next medium. For example, it is possible to prevent double feeding of the previous medium and the next medium or detect the front end of the next medium using a sensor.

In the recording apparatus according to the invention, the recording apparatus in which the transporting operation is performed in plural when recording is performed with respect to one medium may further include a determining device which determines an operation for transporting the medium which passes through a predetermined position is performed. If it is determined that the operation for transporting the medium which passes through the predetermined position is performed, when the driving of the first transporting device and the second transporting device starts after pause, the controller may determine the second transporting device to the transporting device which is to be driven first, determine the first transporting device to the transporting device which is to be driven first, start the driving of the second transporting device, and start the driving of the first transporting device when the position parameter according to the driving amount of the second transporting device reaches the predetermined value corresponding to the gap.

By this configuration, the transporting operation is performed in plural and the recording on one medium is performed. If the transporting operation is determined to the transporting operation in which the medium passes through the predetermined position, when the driving of the first transporting device and the second transporting device starts after pause, the second transporting device is determined to the transporting device which is to be driven first and the first transporting device is determined to the transporting device which is to be driven first. The controller first starts the driving of the second transporting device and then starts the driving of the first transporting device when the position parameter according to the driving amount of the second transporting device reaches the predetermined value corresponding to the gap. As a result, the necessary gap between the previous medium and the next medium is ensured.

In the recording apparatus according to the invention, the first transporting device may be a feeding device for feeding the medium and the second transporting device may be a medium transporting device for transporting the medium fed by the feeding device to the downstream position of the feeding device in the transporting direction.

By this configuration, it is possible to suitably transport the medium using the feeding device and the medium transporting device for transporting the medium fed by the feeding device.

According to another aspect of the invention, there is provided a method of transporting a medium in a recording apparatus including a first transporting device which transports a medium, a second transporting device which transports the medium transported by the first transporting device, and a recording device which performs recording on the medium transported by the second transporting device, the method including: first determining one transporting device which is to be driven first from among the first and second transporting devices according to a condition; and controlling a startup timing of the other transporting device which is to be subsequently driven, on the basis of a position parameter according to a driving amount of the one transporting device which is to be driven first from among the first and second transporting devices. According to this method, the same effect as the recording apparatus is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
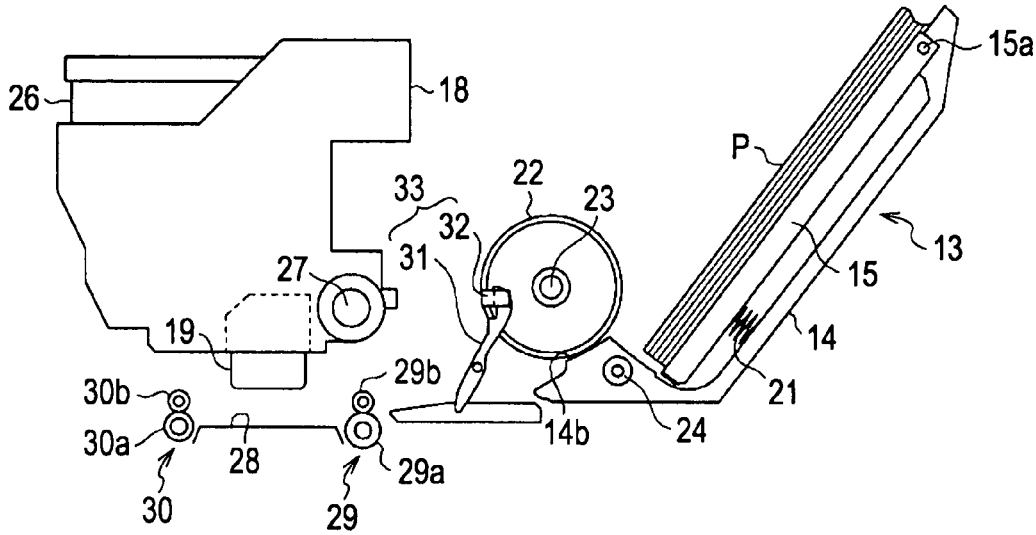
FIGS. 1A and 1B are schematic side views illustrating an operation of an auto sheet feeder (ASF) of an embodiment of the invention.

Hereinafter, a printer according to an embodiment of the invention will be described with reference to FIGS. 1 to 8. FIG. 2 is a perspective view of the printer according to the present embodiment.

The printer 11 which is a recording apparatus is, for example, an ink jet printer. The printer 11 includes an auto sheet feeder (hereinafter, referred to as an ASF 13) which is mounted at a rear surface side of a main body 12 and functions as a first paper feeder and a feeding device for feeding a sheet of paper P as a medium. The ASF 13 includes a feeding tray 14, a hopper 15, an edge guide 16, and a sheet guide 17 including a sheet support 14*a*. The ASF 13 includes a feed driving mechanism for feeding sheets stored in the sheet guide 17 to the main body 12 one by one.

The main body 12 includes a carriage 18 which reciprocally moves in a main scanning direction (an X direction of FIG. 2) and a recording head 19 mounted on a lower surface of the carriage 18. The sheet P is printed by alternately repeating a recording operation for injecting ink from the recording head 19 to the sheet P and a sheet transporting operation for transporting the sheet P in a sub scanning direction Y by a predetermined transport amount while the carriage 18 is moved in the main scanning direction X. The printed sheet P is ejected through an ejection port 12A which is formed in a lower side of a front surface of the main body 12. A recording device is configured by the carriage 18 and the recording head 19.

FIG. 1 shows the ASF and a paper feeder. As shown in FIG. 1, the hopper 15 is supported on the surface of the feeding tray 14, which is obliquely mounted at the rear surface side of the main body, such that the hopper is rotated around a shaft 15*a* located at an upper end thereof in a predetermined angle range. The hopper 15 is urged in a direction so as to be separated from the feeding tray 14 by a compression spring 21 interposed between the feeding tray 14 and the hopper 15.

A cylindrical feeding roller 22 is mounted in the vicinity of a lower end of the hopper 15 to be rotated around a rotary shaft 23. The hopper 15 is reciprocally moved between a withdrawn position shown in FIG. 1A and a feeding position shown in FIG. 1B.

A guide portion 14*b* is provided on the surface of a downstream end (a left end, in FIG. 1) of the feeding tray 14. A retardation roller 24 is provided at a position opposed to the feeding roller 22 in the vicinity of an upper end of the guide portion 14*b*. The retardation roller 24 is driven and rotated in a state in which a rotation load is applied by a torque limiting mechanism such as a torque limiter and is moved close to and away from the feeding roller 22. In the present embodiment, the hopper 15 and the retardation roller 24 operate while interlocked with each other.

The carriage 18 having an ink cartridge 26 mounted therein is provided at a downstream side of the ASF 13 in a sheet transporting direction to be moved along with a guide shaft 27 in the main scanning direction X (perpendicular to the paper surface of FIG. 1). A platen 28 is provided below the recording head 19 with a predetermined gap provided therebetween. A paper transporting roller 29 and an ejection roller 30 are provided with the platen 28 interposed therebetween in the sub scanning direction (horizontal direction of FIG. 1).

The paper transporting roller 29 includes a pair of a transport driving roller 29*a* and a transport driven roller 29*b* and the ejection roller 30 includes a pair of an ejection driving roller 30*a* and an ejection driven roller 30*b*. In the present embodiment, the transport driving roller 29*a* and the ejection driving roller 30*a* are driven by a PF motor 58 (a paper transporting motor) (see FIG. 5) to transport and eject the sheet P in cooperation with each other. The feeding roller 22 is driven by an ASF motor 56 (feeding motor) (see FIG. 5) to feed and transport the sheet P in cooperation with the paper transporting roller 29.

A paper detection sensor 33 including a lever 31 which extends such that a lower end thereof reaches a sheet transporting path and an optical sensor portion 32 for detecting an upper end of the lever 31 are provided between the feeding roller 22 and the paper transporting roller 29. The paper detection sensor 33 is turned off when the lever 31 is positioned at an original position shown in FIG. 1A by an urging force of a spring in a state in which the sheet P presses the lower end of the lever 31 does not exist, and is turned on when a sheet P1 presses the lower end of the lever 31 and the lever 31 is rotated during feeding as shown in FIG. 1B. In more detail, the sensor portion 32 includes a light-emitting portion and a light-receiving portion, the lever 31 which blocks the light emitted from the light-emitting portion is pressed by the sheet P1 and is rotated, and the light-receiving portion receives the emitted light, thereby turning on the paper detection sensor 33.

Figure 1B:
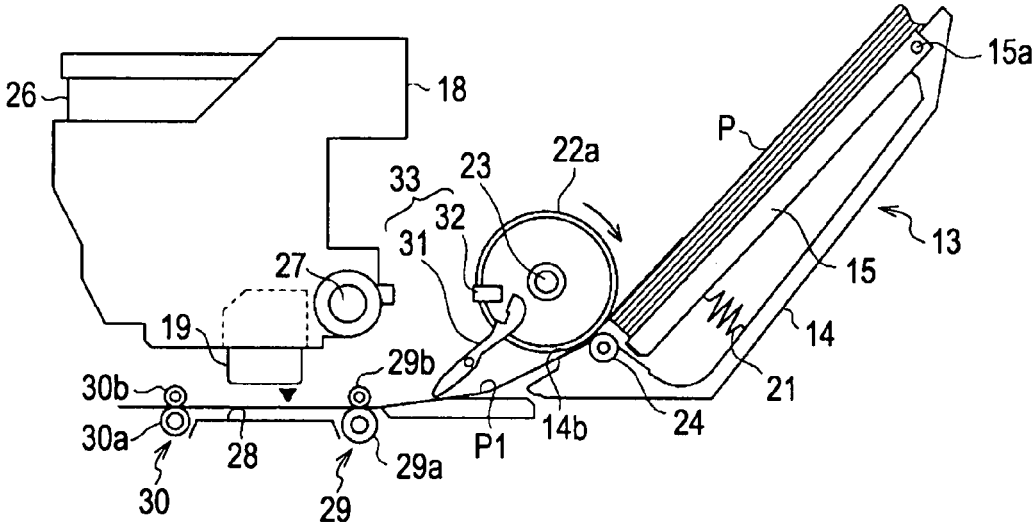
Figure 2:
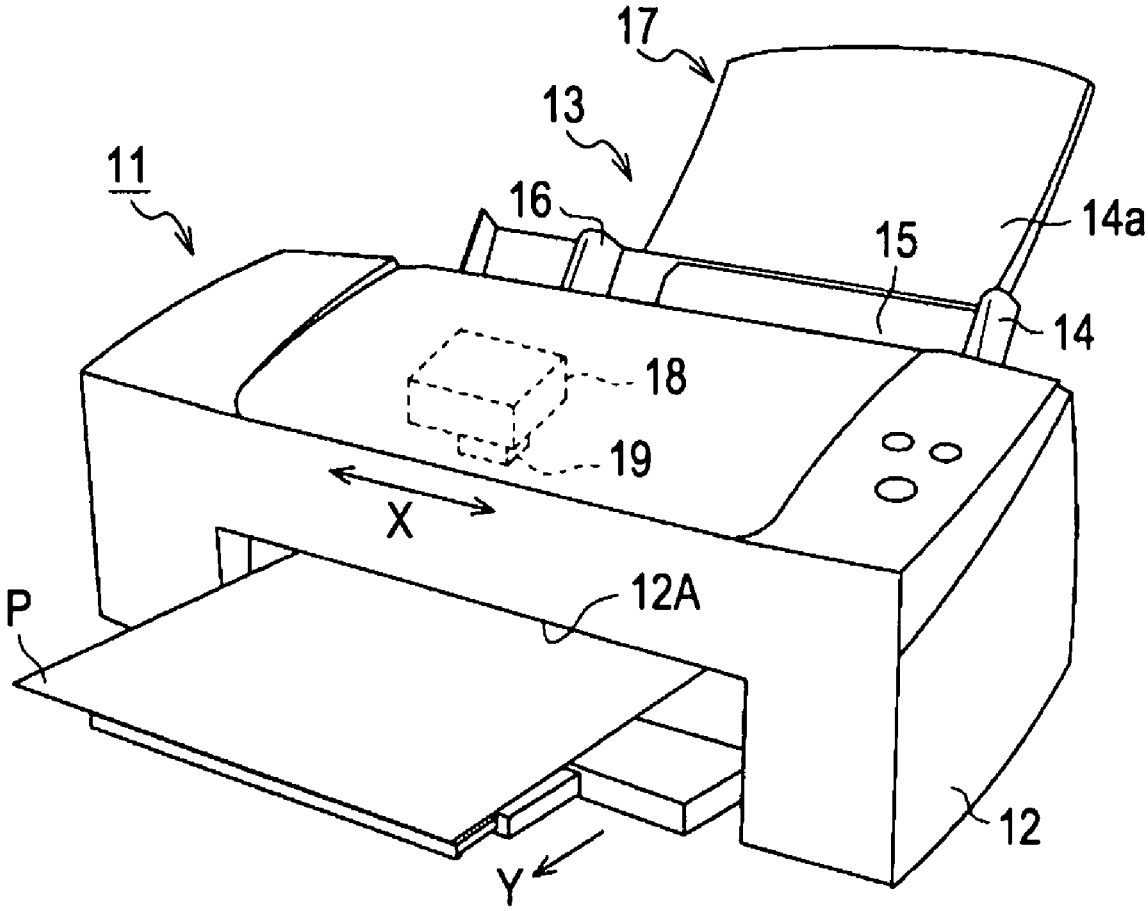
FIG. 2 is a perspective view of a printer.

The retardation roller 24 can be moved upward or downward between the withdrawn position where the roller is separated from an outer circumferential surface of the feeding roller 22 as shown in FIG. 1A and the feeding position where the roller contacts the outer circumferential surface of the feeding roller 22 as shown in FIG. 1B. At the time of a standby state shown in FIG. 1A in which printing is not performed, the retardation roller 24 is moved downward and is positioned at the withdrawn position so as to be separated from the feeding roller 22. At the time of printing shown in FIG. 1B, the retardation roller 24 is moved upward and is positioned at a position where the sheet is nipped between the feeding roller 22 and the retardation roller 24, the hopper 15 is rotated in the urging direction of the compression spring 21 while interlocked with the retardation roller 24, and the sheets P laminated on the hopper 15 are pressed to the feeding roller 22.

Among the sheets P pressed to the feeding roller 22 by the hopper 15 being moved upward, an uppermost sheet is fed and inserted between the feeding roller 22 and the retardation roller 24 by the rotation of the feeding roller 22. In the feeding operation, only the uppermost sheet P1 of the sheets P pressed to the feeding roller 22 is separated from the other sheets and is fed by balancing rotation resistance of the retardation roller 24, friction resistance of the circumferential surface of the feeding roller 22, and friction resistance of the surface of the sheet P.

The retardation roller 24 and the hopper 15 returns to the withdrawn position when no sheet to be subsequently fed is present after the sheet is set. Accordingly, when the sheet which will be subsequently fed is present, the hopper 15 and the retardation roller 24 are held at the feeding position shown in FIG. 1B.

When the feeding roller 22 is continuously rotated, a previous sheet P1 and a next sheet P2 are continuously fed without a gap therebetween. However, if a gap occurs between the previous sheet P1 and the next sheet P2, the lever 31 is not returned to the original position shown in FIG. 1A even when the rear end of the previous sheet P1 passes through the lower end of the lever 31 of the paper detection sensor 33 and thus the front end of the next sheet P2 cannot be detected.

Figure 3:
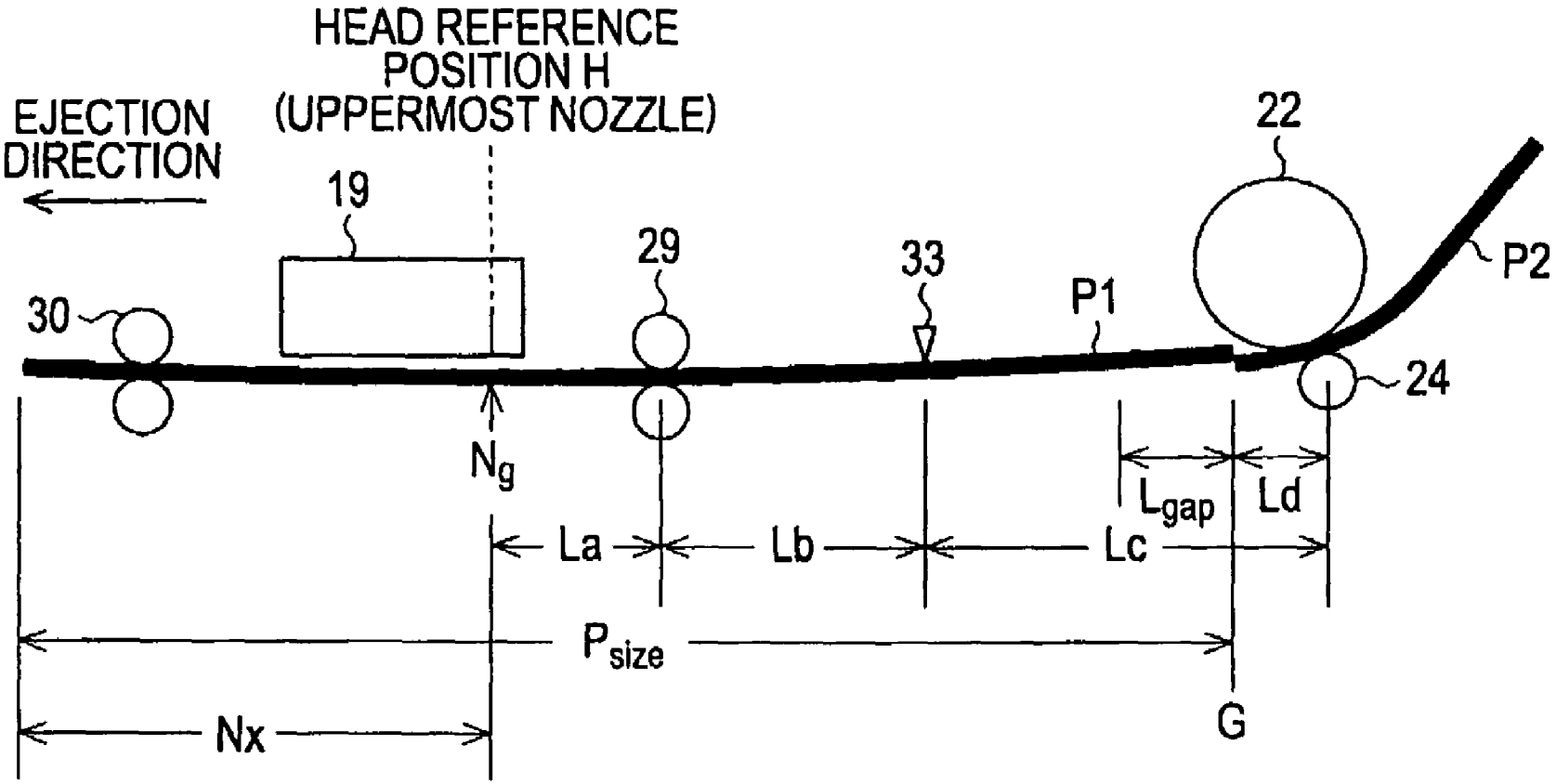
FIG. 3 is a schematic side view showing a transport mechanism for transporting a sheet from the ASF.

A method of ensuring the presence of the gap between the sheets P1 and P2 may include a method of moving the hopper 15 and the retardation roller 24 to the withdrawn position when the previous sheet P1 is not nipped between the feeding roller 22 and the retardation roll 24 (see FIG. 3). However, according to this method, when the sheet is withdrawn even in a short time of 1 second or less at the time of the ejection of a sheet or the feed of a relatively long sheet, the gap between the previous sheet and the next sheet is excessively increased and thus printing throughput deteriorates. The present embodiment employs an interpage control method of controlling the motors for driving the feeding roller 22 and the paper transporting roller 29 to cooperate with each other while the hopper 15 and the retardation roller 24 are held at the feeding position such that a necessary gap between the previous sheet and the next sheet is ensured. The interpage control method will be described later.

The front end of the fed sheet P1 passes through the paper transporting roller 29 to reach a print start position between the carriage 18 and the platen 28. A plurality of nozzles (nozzle group) for ejecting ink are formed in the lower surface of the recording head 19 and the position of a nozzle (upstream nozzle) located at an upstream side of a transporting direction in the nozzle group is a head reference position (position denoted by "▼" in FIG. 1B). The sheet P1 is transported to a position where the print start position of the sheet is identical to the head reference position such that the sheet P1 is set.

A setting position is determined according to a layout condition with or without a margin (top margin) for determining the print start position of the sheet and a transporting distance is determined according to the setting position at the time of feeding the sheet. After the feeding of the sheet P1 is finished (that is, after the sheet is set), a printing operation and a paper transporting operation of the recording head 19 are alternately performed to perform printing.

In the present embodiment, the transport of the sheet until the fed sheet is set is defined as a "feeding operation", the transport of the sheet until the set sheet is printed is defined as a "paper transporting operation", and the transport of the sheet until the rear end of the printed sheet is not detected by the paper detection sensor 33 is defined as an "ejecting operation". When the sheet is transported from a time point when printing is finished to a time point when the rear end of the sheet is not detected by the paper detection sensor 33, the ejecting operation of the sheet is not performed and the feeding operation of a next sheet is performed. The ejection roller 30 is rotated in the feeding operation such that the previous sheet is ejected.

FIG. 3 is a schematic side view of the ASF and the paper feeder (PF). A variety of positions and distances defined in the interpage control process will be described using FIG. 3. The position of an uppermost nozzle of the recording head 19 is the head reference position H. A distance between the head reference position H (uppermost nozzle) and a nip point of the paper transporting roller is La, a distance between the nip point of the paper transporting roller and the paper detection sensor 33 is Lb, and a distance between the paper detection sensor 33 and a nip point of the feeding roller (a nip point between the feeding roller 22 and the retardation roller 24) is Lc.

When the previous sheet P1 is transported to the position of FIG. 3, the sheet P1 is released from being nipped by the feeding roller 22. When the previous sheet P1 is nipped by the feeding roller 22 and the paper transporting roller 29 (see FIG. 1), the feeding roller 22 and the paper transporting roller 29 need to be driven at substantially the same transporting speed. However, after the sheet is transported to the position of FIG. 3, the feeding roller 22 and the paper transporting roller 29 do not need to be driven at the same transporting speed. Here, the reason why the feeding roller 22 and the paper transporting roller 29 are driven at the same speed in a period in which the previous sheet P1 is nipped at two points (between engagement positions) between the feeding roller 22 and the paper transporting roller 29 is because the previous sheet P1 is prevented from being excessively or loosely drawn at a portion between the both nips to inadequately transport the sheet.

However, since the previous sheet P1 and the next sheet P2 are separately transported after the end (rear end) of the upstream side of the transporting direction of the sheet P1 is released from being nipped by the feeding roller 22, the feeding roller 22 and the paper transporting roller 29 do not need to be simultaneously driven. In the present embodiment, when the rear end of the previous sheet P1 is released from being nipped by the feeding roller 22, the rotation of the feeding roller 22 is stopped, the sheet P1 is transported by the paper transport roller 29 while the rotation of the feeding roller 22 is stopped such that the gap between the previous sheet P1 and the next sheet P2 is ensured, the rotation of the feeding roller 22 is resumed, and the feeding of the next sheet P2 is resumed. By performing the interpage control process, the necessary gap between the sheets P1 and P2 is ensured. When the gap between the sheets P1 and P2 is ensured, the paper detection sensor 33 is turned off by the gap being detected and the paper detection sensor 33 is then turned on by detecting the front end of the next sheet P2 being detected. Thus, the next sheet P2 can be detected by the paper detection sensor 33. Accordingly, the next sheet P2 which is transported from the reference position by a predetermined distance on the basis of the position detected by the paper detection sensor 33 can be set.

After the previous sheet P1 is released from being nipped by the feeding roller 22, an interpage control position G which is a stop position where the rotation of the feeding roller 22 is stopped is set to a position where the front end of the next sheet P2 has exited from the nip point of the feeding roller by the distance Ld. The distance Ld corresponds to a margin in which the feeding roller 22 can be stopped after the previous sheet P1 is released from being nipped by the feeding roller 22. In the present embodiment, a time point when the front end of the sheet P1 reaches a position opposed to the head reference position H is set to "0" and the transporting distance of the sheet P1 is counted by a paper transporting amount counter 65 (see FIG. 5) such that the position of the sheet P1 is managed on the basis of a count value Nx indicating a distance from the front end of the sheet P1 to the head reference position H. That is, the position of the sheet P1 is managed by managing the position of the sheet P1 opposed to the head reference position H on the basis of the count value Nx. Here, when the rear end of the previous sheet P1 reaches the interpage control G, the position of the sheet P1 opposed to the head reference position H is set to an interpage control position Ng.

In FIG. 3. La is a distance between uppermost nozzle and nip point of paper transporting roller. Lb is a distance between nip point of paper transporting roller and paper detection sensor. Lc is a distance between paper detection sensor and nip point of feeding roller. Ld is a distance of front end of next page jumped out from nip point of feeding roller. $L_{gap}$ is a distance between pages. $P_{size}$ is a distance of sheet specified by printer driver. Nx is a paper transporting amount (count value of paper transporting amount counter). In FIG. 3, a distance $L_{gap}$ is a distance (hereinafter, referred to as a gap distance $L_{gap}$) by which the sheets P1 and P2 are separated. After the sheet P1 is transported from the interpage control position by the gap distance $L_{gap}$, the rotation of the feeding roller 22 which is paused is resumed. A reference character $P_{size}$ is a sheet distance (transporting direction distance) specified by a printer driver. A position obtained by subtracting a distance (La+Lb+Lc−Ld) from the sheet distance $P_{size}$ is the interpage control position Ng. Accordingly, the interpage control position Ng varies according to the sheet distance $P_{size}$. When the paper transporting amount which is the count value of the paper transporting amount counter 65 reaches the value Ng which is $P_{size}$−(La+Lb+Lc−Ld), it is determined that the sheet P1 has reached the interpage control position Ng.

Next, the electrical configuration of the printer will be described with reference to FIG. 5.

Figure 5:
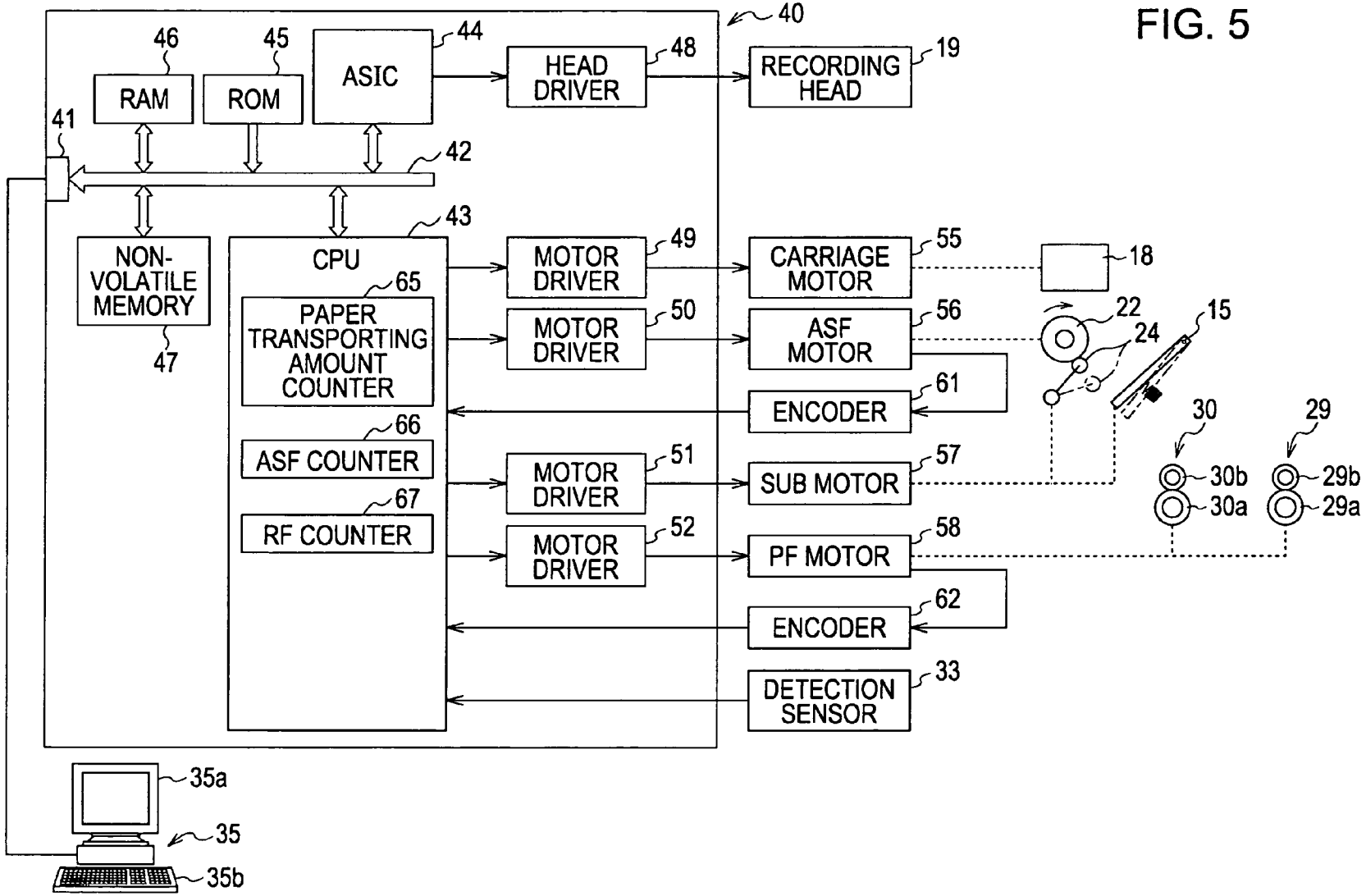
FIG. 5 is a block diagram showing an electrical configuration of the printer.

As shown in FIG. 5, the printer 11 includes a controller 40 for performing a variety of controls. The controller 40 includes an interface 41 connected to a host computer 35 (PC). A bus 42 connected to the interface 41 is connected to a CPU 43, an application specific integrated circuit (ASIC) 44, a ROM 45, and a RAM 46. The CPU 43 executes a program stored in the ROM 45 to perform a feeding control, a paper transporting control, a printing control and an ejection control.

The host computer 35 includes a printer driver (not shown) and acquires a variety of printing parameters, such as a sheet size, a sheet type, and a layout, which are set by allowing a user to operate an input device 35*b* on a print setting screen displayed on a display device 35*a* on the basis of an instruction input by the user. The printer driver performs a predetermined process and generates printing data when receiving the printing instruction from the input device 35*b*. In more detail, the printer driver sequentially performs a resolution conversion process for converting image data to be printed from display resolution to print resolution, a color conversion process for converting an RGB color coordinate system to a CMYK color coordinate system, a halftone process for converting a gradation value to one which can be expressed by the printer 11, and a rasterizing process (micro-weaving process) for rearranging data sequence (discharge sequence) to be transported to the printer 11. A header including a command is attached to the obtained print image data to generate the printing data. The header includes a printing parameter including the sheet size or a parameter such as a target speed or a transporting distance (paper transporting amount or the like) at the time of transporting the sheet, which indicates contents instructed by the command, in addition to the command.

The CPU 43 receives the printing data from the printer driver of the host computer 35 through the interface 41 and the bus 42. The CPU 43 acquires the sheet distance $P_{size}$ from the header of the printing data which is first received from the host computer 35. The CPU 43 analyzes the command included in the header of the printing data and acquires a variety of commands such as feed, transport and ejection of the sheet and the parameters which express the instructions in the form of numerical values, such as the target speed and the transporting distance of the sheet at the time of feeding, transporting and ejecting the sheet. The target speed instructed by the parameter of the command is set according to a printing mode at the time of feeding, transporting and ejecting the sheet. Examples of the printing mode includes a high-speed printing mode which gives preference to a printing speed over printing quality and a high-image quality mode which gives preference to the printing quality over the printing speed.

The ASIC 44 receives the print image data excluding the header of the printing data from the CPU 43, performs an image process (image development process) on the print image data, and converts the print image data into bit map data having a predetermined gradation value used for generating a discharge signal for discharging an ink droplet from the nozzle of the recording head 19. The ASIC 44 sends the converted bit map data to a head driver 48 for every one pass. The head driver 48 controls the recording head 19 on the basis of the bit map data and discharges the ink droplet from the nozzle.

The CPU 43 is connected to motor drivers 49, 50, 51 and 52. The CPU 43 drives and controls a carriage motor 55, an ASF motor 56 functioning as a first driving source, a sub motor 57, and a PF motor 58 functioning as a second driving source (paper transporting motor) through motor drivers 40 to 52. In more detail, the CPU 43 sends control data to the motor driver 50 and the motor driver 50 drives and controls the ASF motor 56 to be rotated in a rotation direction and at a rotation speed on the basis of the control data. The CPU 43 sends the control data to the motor driver 52 and drives and controls the PF motor 58 to be rotated in a rotation direction and at a rotation speed on the basis of the control data. In the present embodiment, the ASF motor 56 and the PF motor 58 are configured by DC motors. The other motor drivers 49 and 51 drive and control the carriage motor 55 and the sub motor 58 by the same method.

An output shaft of the PF motor 58 is connected to the transport driving roller 29*a* and the ejection driving roller 30*a* through a train (not shown) such that power can be delivered. A second transporting device and a medium transporting device are configured by the PF motor 58 and the paper transporting roller 29.

The ASF motor 56 rotates the feeding roller 22. The sub motor 57 is connected to the retardation roller 24 and the hopper 15 to deliver power such that the retardation roller 24 and the hopper 15 are moved between the withdrawn position and the feeding position while interlocked with each other.

The ASF motor 56 includes a rotary encoder (hereinafter, referred to as an encoder 61) for detecting the rotation of the output shaft thereof, and the PF motor 58 includes a rotary encoder (hereinafter, referred to as an encoder 62) for detecting the rotation of the output shaft thereof. The encoders 61 and 62 generate and output pulse signals having respective periods proportional to rotation speeds of the motors corresponding thereto. The CPU 43 is connected to the paper detection sensor 33 and the encoders 61 and 62 and the CPU 43 receives an on/off signal of the paper detection sensor 33 and the pulse signals from the encoders 61 and 62.

The CPU 43 includes the paper transporting amount counter 65, the ASF counter 66 and the PF counter 67. The paper transporting amount counter 65 is reset by the CPU 43 when the paper detection sensor 33 is turned on and pulse edges of the pulse signal received from the encoder 62 are counted after the reset. Thereafter, when the paper transporting amount counter 65 counts a count value corresponding to the transporting amount up to a position where the sheet P1 is set, the driving of the ASF motor 56 is stopped and the sheet P1 is fed (set). After the feeding of the sheet is finished, the count value of the paper transporting amount counter 65 is updated to a count value corresponding to a paper transporting amount in which the position of the sheet P when the front end of the sheet P1 reaches the head reference position H (uppermost nozzle) is set as an original point by subtracting a value corresponding to the distance (La+Lb) shown in FIG. 3 therefrom. Accordingly, the count value Nx of the paper transporting amount counter 65 after the feeding of the sheet is finished becomes a value corresponding to the paper transporting amount in which a time point when the front end of the sheet P1 reaches the head reference position H is set to "0". The CPU 43 checks the position (transport position) of the set sheet P from the count value Nx of the paper transporting amount counter 65.

The ASF counter 66 counts pulse edges of the pulse signal received from the encoder 61 for detecting the rotation of the ASF motor 56. The ASF counter 66 is reset before the driving of the ASF motor 56 starts, and counts the count value corresponding to the feeding amount (transporting amount) of the sheet fed by the feeding roller 22 driven by the ASF motor 56. Accordingly, the CPU 43 can check a position at which the fed sheet is positioned in a section from a feed start position and a feed end position, from the count value of the ASF counter 66. The CPU 43 checks the distance of the sheet along a sheet feeding path, in which the feed start position is set to an original point, from the count value of the ASF counter 66, and controls the speed of the ASF motor 56 by setting a speed according to the distance (that is, the position from the feed start position) as one piece of information of the control data by referring to an acceleration/deceleration table (not shown).

The PF counter 67 counts pulse edges of the pulse signal received from the encoder 62 for detecting the rotation of the PF motor 58. The PF counter 67 is reset before the driving of the PF motor 58 starts, and counts the count value corresponding to the feeding amount (transporting amount) of the sheet fed by the feeding roller 22 driven by the RF motor 58. Accordingly, the CPU 43 can check a position at which the fed sheet is positioned in a section from a paper transport start position and a paper transport end position, from the count value of the PF counter 67. The CPU 43 checks the distance of the sheet on a sheet feeding path, in which the feed start position is set to an original point, from the count value of the ASF counter 66, and controls the speed of the PF motor 58 by setting a speed according to the distance as one piece of information of the control data by referring to the acceleration/deceleration table (not shown). In more detail, the CPU 43 reads the acceleration/deceleration table from a non-volatile memory 47 and controls the speeds of the ASF motor 56 and the PF motor 58 so that they become a speed corresponding to the distance from the feed start position according to the acceleration/deceleration table.

The control data of the CPU 43 includes a voltage command value. The motor drivers 50 and 52 control the voltages applied to the ASF motor 56 and the PF motor 58 respectively corresponding thereto according to the received voltage command value. Current values flowing in the ASF motor 56 and the PF motor 58 are determined by the voltages to obtain rotation torques according to the current values. The voltage command values are determined using a separate table for each distance or each speed range obtained by dividing an acceleration/deceleration range.

In the present embodiment, the acceleration/deceleration table includes a data group indicating the correspondence relationship between the distance and the period and the CPU 43 sequentially sends the periods (target period) according to the distances indicated by the count values of the ASF counter 66 and the PF counter 67 to the motor drivers 50 and 52. The periods are values corresponding to the periods of the pulse edges of the pulse signal received from the encoders 61 and 62. The edge periods of the pulses acquired from the encoders 61 and 62 may be counted to perform a feedback control such that the counted detection period is equal to the target period.

In the present embodiment, the CPU 43 controls the ASF motor 56 functioning as the first driving source and the PF motor functioning as the second driving source to cooperate with each other. At this time, the CPU 43 determines a motor, which is to be driven first, and a motor (standby motor), which is to be subsequently driven, between the two motors 56 according to a given condition. The CPU 43 sets a standby distance for determining a start-up timing of the motor which is to be subsequently driven according to a given condition. If a position parameter indicated by a pulse count value according to a driving amount of the motor which is to be driven first reaches a standby end position defined by the standby distance, the driving of the motor which is to be subsequently driven is permitted.

In order to allow the CPU 43 to control the two motors 56 and 58 to cooperate with each other, the program stored in the ROM 45 defines (A) to (F) as rules of the motor cooperation control including the above-described control contents.

(A) A standby distance is set in order to determine a startup timing of a standby motor and a standby end position where driving of a driving amount corresponding to the standby distance is finished is set with respect to the motor which is to be driven first.

(B) When the motor which is to be driven first is driven to the standby end position, driving permission is given to the standby motor.

(C) The standby motor continuously stands by until the motor which is to be driven first gives the driving permission and starts the driving when the driving permission is given.

(D) When the standby distance is "0", the standby motor immediately starts the driving without waiting for the driving permission.

(E) When the motor which is to be driven first finishes the driving due to an error before reaching the standby end position, the standby motor stops standing by and starts driving.

(F) When the motor being driven first is stopped due to an error, the standby motor stops standing by but does not perform driving.

If the motor which is to be driven first is the ASF motor 56, it is determined whether the motor has reached the standby end position, according to whether the count value of the ASF counter 66 reset before the motor driving starts has reached a value corresponding to the standby distance. If the motor which is to be driven first is the PF motor 58, it is determined whether the motor has reached the standby end position, according to whether the count value of the PF counter 67 reset before the motor driving started has reached a value corresponding to the standby distance. The position parameter corresponding to the driving amount of the motor indicates the count values of the ASF counter 66 and the PF counter 67.

When the two motors 56 and 58 are simultaneously driven, the standby distance is set to "0". In this case, any one of the two motors 56 and 58 is to be driven first and the other thereof is to be subsequently driven in the processing of the CPU 43, but the two motors 56 and 58 are simultaneously driven in actual fact.

The reason why, when the motor which is to be driven first is stopped due to an error before the motor has reached the standby end position, the standby motor stops standing by and starts driving is to prevent the standby motor which will be subsequently driven from remaining in a standby state when the motor which is to be driven first has stopped due to the error.

The reason why, when the motor which is to be driven first is stopped due to the error before the motor has reached the standby end position, the standby motor stops standing by and does not perform the driving is because it is not preferable that either motor is driven when an error occurs.

The printer 11 according to the present embodiment controls the two motors 56 and 58 to cooperate with each other and performs a sheet transporting control on the basis of the above rules. The ROM 45 stores a program for a sheet transporting control process routine shown in the flowchart of FIG. 6. The CPU 43 executes this program to perform a motor cooperation control such that the two motors 56 and 58 are driven while interlocked with each other to suitably perform the sheet transporting operation. For example, the previous sheet is relatively loosely transported or the sheets are transported such that a predetermined gap between the previous sheet and the next sheet is maintained.

When the ASF motor 56 is to be driven first and the PF motor 58 is to be subsequently driven, the transporting operation in which the previous sheet P1 is transported while being nipped by the feeding roller 22 and the paper transporting roller 29 may be performed. In this case, the previous sheet P1 nipped by the feeding roller 22 and the paper transporting roller 29 satisfies a condition that the count value Nx of the paper transporting amount counter 65 does not exceed the interpage control position Ng (Nx<Ng). When the sheet is transported while this condition (both-nip condition) is satisfied, the ASF motor 56 is selected as the motor which is to be driven first and the PF motor 58 is selected as the motor which is to be subsequently driven. A value w for giving predetermined looseness to the previous sheet is set as the standby distance. When the ASF motor 56 which is to be driven first is driven by the standby distance and the count value of the ASF counter 66 has reached the value w indicating the standby end position, the driving of the PF motor 58 which is to be subsequently driven is permitted. The start-up timing of the motor which is to be subsequently driven is determined by the set standby distance w.

Figure 7:
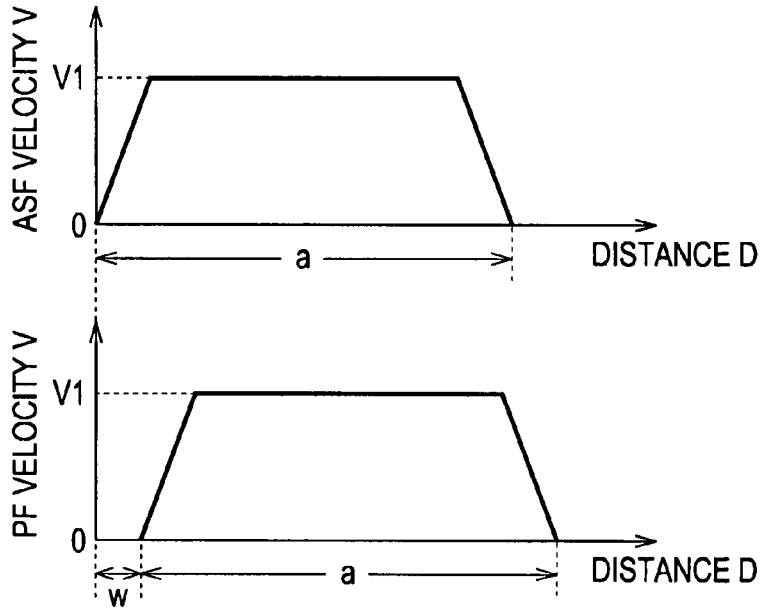
FIG. 7 is a graph showing a speed waveform in a transport operation when a both-nip conditions is satisfied.

A graph shown in FIG. 7 indicates a speed profile from when the driving of the PF motor 58 starts at a time point delayed from a time point when the driving of the ASF motor 56 by the standby distance w starts, in order to somewhat loosely transport the previous sheet P1. Here, a horizontal axis indicates a distance corresponding to the count value of the counter and a vertical axis indicates a speed V. The standby distance w is set with a value necessary for giving the predetermined looseness to the previous sheet. In the present embodiment, the driving start of the PF motor 58 is delayed from the driving start of the ASF motor 56 by the standby distance w, but the driving amounts of the ASF motor 56 and the PF motor 58 are set such that the transporting distances of the previous sheet transported to the feeding roller 22 and the paper transporting roller 29 are identical. In the present embodiment, a deceleration ratio of the train and a deceleration ratio determined by the diameter of the roller are made identical by an ASF driving system and a PF driving system and the values of the distance Dy corresponding to the driving amounts of the ASF motor 56 and the PF motor 58 are "a". Accordingly, the ASF motor 56 is to be driven first and the PF motor 58 is to be subsequently driven at a time point when the ASF motor 56 has been driven by the standby distance, such that the predetermined looseness is given to the previous sheet P1. Then, the previous sheet P1 is transported by the transporting distance a in a state in which the predetermined looseness is given, the driving of the ASF motor 56 is first stopped, and the driving of the PF motor 58 is stopped after the standby distance w.

Meanwhile, when the PF motor 58 is to be driven first and the ASF motor 56 is to be subsequently driven, the transporting operation (interpage control transporting operation) in which the previous sheet P1 passes through the interpage control position Ng may be performed from the position where the previous sheet P1 is nipped by the feeding roller 22 and the paper transporting roller 29. Whether the interpage control transporting operation is performed is determined according to whether the previous sheet P1 is nipped by the feeding roller 22 and the paper transporting roller 29 (Nx<Ng) and whether the count value (Nx+Dy) of the paper transporting amount counter 65 when the transporting operation (transporting distance Dy) is performed exceeds the interpage control position Ng (Nx+Dy>Ng) is determined. In the transporting operation, when the conditions of Nx<Ng and Nx+Dy>Ng are satisfied, the transporting operation is divided into a first transporting operation in which the previous sheet is transported from the current position Nx to the interpage control position Ng and a second transporting operation in which the next sheet is transported with the predetermined gap from the previous sheet while the previous sheet is transported from the interpage control position Ng to the transport end position Nx+Dy. The ASF motor 56 and the PF motor 58 perform the first transporting operation by the motor cooperation control when the sheet is nipped by the feeding roller 22 and the paper transporting roller 29 until the count value Nx of the paper transporting amount counter 65 reaches the interpage control position Ng. When the rollers pause at the interpage control position Ng and perform the second transporting operation from the interpage control position Ng to the transport end position Nx+Dy, the interpage control condition in which the current position Nx is equal to the interpage control position Ng is satisfied. When the interpage control condition (Nx=Ng) is satisfied, the PF motor 58 is selected as the motor which is to be driven first and the ASF motor 56 is selected as the motor which is to be subsequently driven. At this time, the interpage control distance $L_{gap}$ is set as the standby distance. When the PF motor 58 which is to be driven first is driven by the standby distance $L_{gap}$, the driving of the ASF motor 56 which is to be subsequently driven is permitted. The start-up timing of the ASF motor 56 which is to be subsequently driven is determined by the set standby distance $L_{gap}$.

Figure 4:
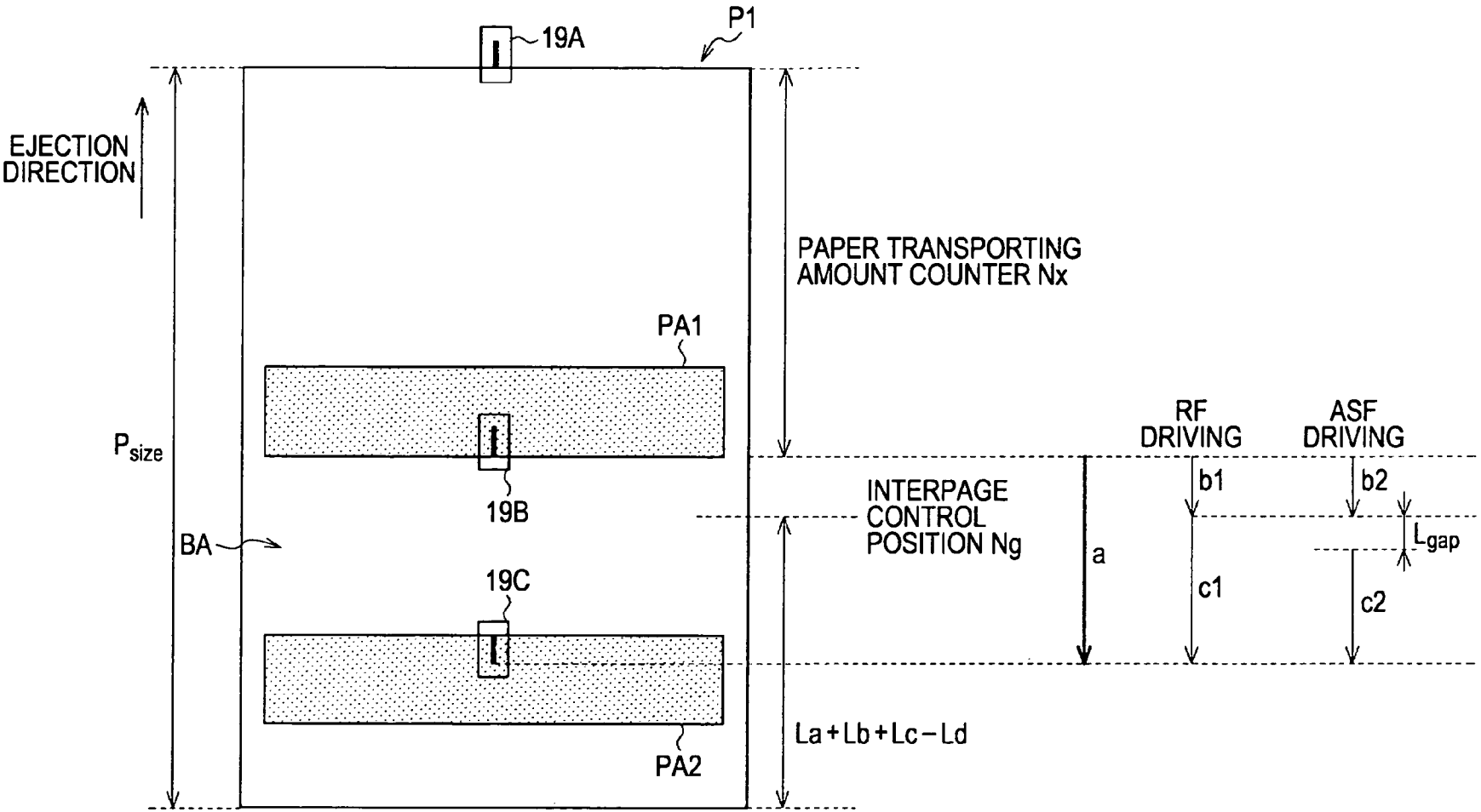
FIG. 4 is a schematic plan view illustrating transport of the sheet passing through an interpage control position.

FIG. 4 is a schematic view of a sheet for explaining the interpage control executed at the time of the transporting operation for passing the sheet through the interpage control position Ng. In FIG. 4, an upper direction denoted by an arrow is an ejection direction (paper transporting direction). In FIG. 4, the recording head 19 is moved relative to the sheet P1 when the recording head 19 is moved together with the sheet P1. In FIG. 4, thick lines in the recording heads 19 (19A to 19C) indicate a nozzle array.

The recording head 19A indicates the recording head position when the front end of the sheet P1 is positioned at the head reference position H. After the sheet P1 is set, the printing is performed row by row from the front end (upper end of FIG. 4) of the sheet P1, the sheet is transported whenever the printing of one line (one pass) is performed, and the printing is performed downward from the upper end. At this time, the recording head is moved relative to the sheet P1 from the upper side to the lower side of FIG. 4. Hatched areas of the sheet P1 shown in FIG. 4 indicate print areas PA1 and PA2 in which the recording head 19 performs the printing. As shown in FIG. 4, if a blank area bA in which the printing is not performed is present between the two print areas PA1 and PA2, the recording head 19B completing the printing of the print area PA1 is moved to the position of the recording head 19C which is the print start position of the print area PA2, by transporting the sheet. When the sheet passes through the interpage control position Ng while the sheet is being transported, the paper transporting operation of the transporting distance a is divided into the first transporting operation from the current position to the interpage control position Ng and the second transporting operation from the interpage control position Ng to the transport end position Nx+a. At this time, the driving of the PF motor 58 (also called "PF driving") is divided into driving of a transporting distance b1 and a transporting distance c1 and the driving of the ASF motor 56 (also called "ASF driving") is divided into driving of a transporting distance b2(=b1), standing by of the standby distance $L_{gap}$, and driving of a transporting distance c2.

The PF driving of the transporting distance b1 and the ASF driving of the transporting distance b2 are substantially performed at the same transporting speed (actually, a difference in startup timing corresponding to the standby distance w at the time of satisfying the both nip condition occurs). This is because the previous sheet P1 is nipped by the feeding roller 22 and the paper transporting roller 29 when the sheet is transported before reaching the interpage control position Ng and thus the feeding roller 22 and the paper transporting roller 29 need to be synchronously driven. In the present embodiment, since the previous sheet P1 is transported while looseness is slightly given to the previous sheet P1, the PF driving first starts and the ASF driving starts after the standby distance w.

When the PF driving of the transporting distance b1 is finished, the PF driving of the transporting distance c1 starts. Meanwhile, with respect to the ASF driving, after the feeding operation of the transporting distance b2 is finished, the ASF driving of the transporting distance c2 starts at a time point when the previous sheet P1 has been transported by the distance $L_{gap}$ by the PF driving in which the paper transporting operation of the transporting distance c1 starts. Accordingly, the gap corresponding to the distance $L_{gap}$ is maintained between the previous sheet P1 and the next sheet P2 (see FIG. 3).

After the interpage control is finished, since the ASF driving and the PF driving are performed such that the sheet is transported by the same distance, the transport of the previous sheet P1 and the feeding of the next sheet P2 are simultaneously performed while the gap corresponding to the distance $L_{gap}$ is maintained. In FIG. 4, the interpage control position Ng becomes the position corresponding to the distance La+Lb+Lc−Ld) from the rear end of the sheet P1 in the sheet transporting direction. Accordingly, when the count value Nx of the paper transporting amount counter 65 reaches the value Ng indicating $P_{size}$−(La+Lb+Lc−Ld), the previous sheet P1 has reached the interpage control position shown in FIG. 3.

Figure 8:
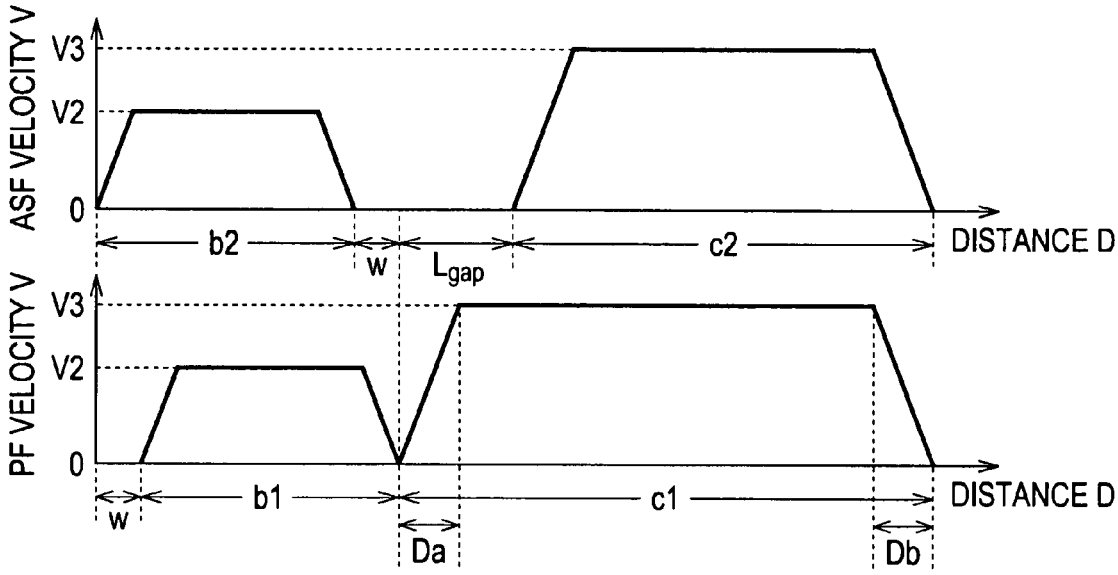
FIG. 8 is a graph showing a speed waveform in an operation for transporting a sheet passing through the control position between the pages.

A graph shown in FIG. 8 shows speed profiles of the ASF driving and the PF driving at the time of the interpage control which is performed in order to ensure the gap $L_{gap}$ between the previous sheet P1 and the next sheet P2 at the time of the transporting operation in which the sheet passes through the interpage control position Ng shown in FIG. 4. A horizontal axis indicates a distance D and a vertical axis indicates a speed V. In the graphs shown in FIGS. 7 and 8, the values of the speed V are different due to the following reason.

That is, in the present embodiment, as shown in FIG. 8, the speed profile has a trapezoidal waveform and the height of the trapezoidal waveform is proportional to the target speed. In a right trapezoidal waveform of the PF driving, as the height (target speed) of the trapezoidal waveform increases, a movement distance Da necessary for acceleration and a movement distance Db necessary for deceleration increase. Accordingly, in order to reach the target speed (e.g., V3 in the graph shown in FIG. 8), a sum Da+Db of the movement distance Da of the acceleration operation from an acceleration start point to the target speed and the movement distance Db of the deceleration operation from the target speed V3 to a stop are required as a minimum distance. The target speed of a constant speed area and the transporting distance are acquired as one piece of information of the header of the printing data and the acceleration/deceleration table corresponding to the target speed is selected. However, if the transporting distance does not reach the minimum distance Da+Db of the acceleration/deceleration table, data for obtaining a highest target speed is selected from other acceleration/deceleration speed data in which the transporting distance is equal to or larger than the minimum distance.

Accordingly, if the transporting distance Dy (for example, Dy=c1, in the example of FIG. 8) is determined, a condition that the transporting distance Dy is equal to or larger than the minimum distance Da+Db becomes the condition of the employable acceleration/deceleration table and an acceleration/deceleration table for obtaining a highest target speed is selected from the acceleration/deceleration tables which satisfy the condition that the transporting distance Dy is equal to or larger than the minimum distance Da+Db. Accordingly, a speed V2 determined according to relatively small transporting distances b1 and b2 is lower than the speed V3 determined according to relatively large transporting distances C1 and C2.

As shown in the graph of FIG. 8, the interpage control is performed by the first transporting operation and the second transporting operation. First, in the first transporting operation, the ASF motor 56, which is determined to be the motor which is to be driven first, is driven, and the count value corresponding to the driving amount after the driving starts is counted by the ASF counter 66. The transporting speed (target speed) at this time is the target speed V2 obtained by referring to the acceleration/deceleration table determined by the transporting distance b2 and the minimum distance condition. At a time point when the count value of the ASF counter 66 reaches the value w and the ASF motor 56 has been driven by the standby distance w, the driving of the PF motor 58 starts. The driving is performed by the same transporting distances b1 and b2(=b1) at the same transporting speed V2 and pauses at a time point when the driving has been performed by the driving amount necessary for allowing the previous sheet P1 to reach the interpage control position Ng. At this time, the ASF motor 56 is first stopped and the PF motor 58 is stopped after the standby distance w has been reached. In the ASF driving and the PF driving, since the setting contents of the ASF acceleration/deceleration table and the PF acceleration/deceleration are different, when the target speeds of the respective acceleration/deceleration tables determined by the transporting distance and the minimum distance condition are different between the ASF driving and the PF driving, the speeds are adjusted to a lower target speed.

After the first transporting operation is finished, the second transporting operation starts and is performed in parallel with the first transporting operation. When the driving of the PF motor 58 by the transporting distance b1 is stopped to finish the first transporting operation, the driving of the PF motor by the transporting distance C1 is resumed and the second transporting operations immediately starts. In the second transporting operation, the PF motor 58 is driven at the target speed V3 by referring to the acceleration/deceleration table determined by the transporting distance C1 and the minimum distance condition. The PF counter 67 counts the count value corresponding to the driving amount after the driving of the PF motor 58 starts and the driving of the ASF motor 56 starts at a time point when the count value has reached the value $L_{gap}$ and the PF motor 58 has been driven by the standby distance $L_{gap}$. When the driving of the PF motor 58 by the transporting distance C1 and the driving of the ASF motor 56 by the transporting distance C2 are stopped, the previous sheet P1 has been transported by the transporting distance a(b1+b2) and the predetermined gap $L_{gap}$ between the previous sheet P1 and the next sheet P2 is ensured.

Figure 6:
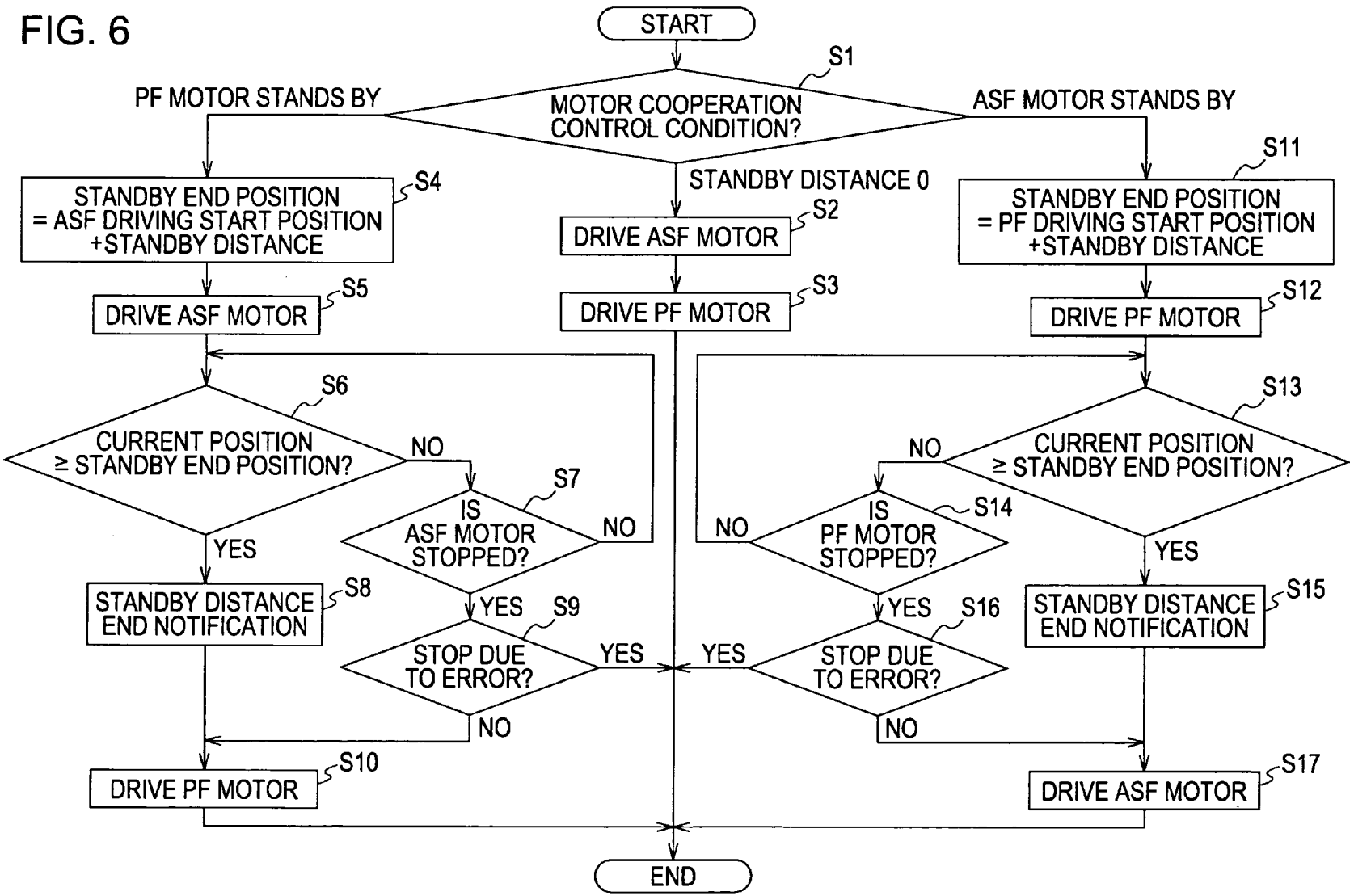
FIG. 6 is a flowchart illustrating a sheet transport control process.

Next, a sheet transport control processing routine shown in FIG. 6 and executed by the CPU 43 will be described. Next, the sheet transport control processing routine executed by the CPU 43 will be described with reference to FIG. 6. Whenever the printing operation of one pass is performed, the target speed and the transporting distance are acquired from the command of the printing data and the transporting operation is performed.

In a step S1, a motor cooperation control condition is determined. The motor cooperation control condition includes a transporting operation condition received by the CPU 43, an operation condition such as the feeding operation, the paper transporting operation, the ejecting operation, and the interpage control position Ng, and a position condition indicating whether the position of the previous sheet reaches the interpage control position Ng or not when the transporting operation is performed, such as the both-nip condition and the interpage control condition. The motor cooperation control condition is divided into three determination results: (a) the ASF motor 56 and the PF motor 58 are simultaneously driven and the standby distance is "0", (b) the PF motor 59 stands by until the standby distance is set and the ASF motor 56 is driven by the standby distance, and (c) the ASF motor 56 stands by until the PF motor 58 is driven by the standby distance.

For example, when one of the feeding operation, the paper transporting operation, and the ejecting operation is commanded and the both-nip condition (Nx<Ng) in which the sheet is nipped by the feeding roller 22 and the paper transporting roller 29 before the current position of the previous sheet reaches the interpage control position Ng is satisfied, the ASF motor 56 is determined to the motor which is to be driven first and the PF motor 58 is determined to the (standby) motor which is to be subsequently driven. In addition, the standby distance is set with the value necessary for giving the looseness to the previous sheet P1.

If the commanded operation is the transporting operation in which the previous sheet P1 passes through the interpage control position Ng, the transporting operation of the transporting distance Dy of the sheet which will be transported at this time is divided into the first transporting operation in which the previous sheet is transported from the current position Nx to the interpage control position Ng and the second transporting operation in which the sheet is transported from the interpage control position Ng to the transport end position. The process of dividing the transporting operation is performed by allowing the CPU 43 to execute another program and the motor cooperation control condition is separately determined at the time of the first transporting operation and the second transporting operation. At this time, the standby distance w is set with respect to the first transporting operation and the standby distance $L_{gap}$ is set with respect to the second transporting operation.

Since the both-nip condition (Nx<Ng) is satisfied when the first transporting operation is performed, the ASF motor 56 is determined to the motor which is to be driven first and the PF motor 58 is determined to the motor which is to be subsequently driven. In addition, the standby distance w is set. Since the interpage control condition (Nx=Ng) is satisfied when the second transporting operation is performed, the PF motor 58 is determined to the motor which is to be driven first and the ASF motor 56 is determined to the motor which is to be subsequently driven. In addition, the standby distance $L_{gap}$ is set.

In the two following cases, the standby distance is set to "0": a case where the feeding operation of a first page is performed, that is, a case where the sheet is not nipped by the feeding roller 22 and the paper transporting roller 29 and a case where the previous sheet P1 exceeds the interpage control position Ng and the sheet is released from being nipped by the feeding roller 22. The feeding operation of the first page can be determined by the information of the header of the printing data and the condition that the count value of the paper transporting counter 65 is "0" and the paper detection sensor 33 is turned off (the previous sheet does not exist). The case where the previous sheet P1 exceeds the interpage control position Ng can be determined by the satisfaction of the condition of Nx>Ng. When such conditions are satisfied, the standby distance is set to "0". The standby distance "0" indicates that the driving of the ASF motor 56 and the driving of the PF motor 58 simultaneously start. The above-described cases are exemplary and a variety of other conditions may be set. It is determined whether any one of the cases (a) to (c) is selected according to the given condition.

In the step S1, if the standby distance is "0" (case (a)), the process progresses to a step S2. If it is determined that the PF motor 58 stands by (case (b)), the process progresses to a step S4. If it is determined that the ASF motor 56 stands by (case (c)), the process progresses to a step S11.

In the step S2, the ASF motor 56 is driven.

In a step S3, the PF motor 58 is driven.

The steps S2 and S3 are substantially simultaneously performed and the ASF motor 56 and the PF motor 58 are simultaneously driven. Although the process in which the ASF motor 56 is to be driven first is described in the flowchart shown in FIG. 6, since the steps S2 and S3 are sequentially performed, for example, for less than several 10 milliseconds, it is actually considered that the steps S2 and S3 are simultaneously driven. In the case where the feeding operation of the first page is performed or the previous sheet P1 exceeds the interpage control position Ng, the ASF motor 56 and the PF motor 58 are simultaneously driven.

In a step S4, "standby end position=ASF driving start position+standby distance" is set as the standby end position. For example, when the both-nip condition is satisfied, standby end position=ASF driving start position+standby distance w is set. Here, the ASF driving start position is the driving start position of the ASF motor 56 and the ASF counter 66 for managing the driving position of the ASF motor 56 as the count value is reset to "0" before the motor driving start. Since the ASF driving start position has a value excluding "0" in a case where the ASF counter 66 is not reset before the motor driving start, the standby end position becomes the ASF driving start position (≠0) plus the standby distance w.

In a step S5, the ASF motor 56 is driven. That is, the driving of the ASF motor 56 which is to be driven first starts.

In a step S6, it is determined whether the current position reaches the standby end position (current position≧standby end position is satisfied). That is, it is determined whether the current position indicated by the count value of the ASF counter 66 reaches the standby end position. If current position≧standby end position is satisfied, the process progresses to a step S8, and, if current position≧standby end position is not satisfied, the process progresses to a step S7.

In the step S7, it is determined whether the ASF motor 56 is stopped. The case where the ASF motor 56 is stopped indicates that the ASF motor 56 is stopped even when current position≧standby end position is not satisfied. The stop of the ASF motor 56 includes a stop due to an error and a stop due to a factor other than the error. In the stop due to the error, the CPU 43 sets an error flag to "1". Accordingly, the CPU 43 can determine whether the stop of the ASF motor 56 is the stop due to the error or due to the factor other than the error, by the error flag.

Before the current position of the sheet reaches the standby end position, the steps S6 and S7 are repeatedly performed until current position≧standby end position is satisfied in the step S6, if it is not determined to the stop of the ASF motor 56 in the step S7.

In the step S8, standby distance end notification is performed. In more detail, the flowchart shown in FIG. 6 includes a main program executed by the CPU 43 and a subroutine executed by an interrupt process. The steps S6, S7, S8, S13, S14 and S15 correspond to the interrupt process. Accordingly, the CPU 43 performs the step S6 of determining whether current position≧standby end position is satisfied or the step S7 of determining whether the ASF motor 56 is stopped. If it is determined that current position≧standby end position is satisfied in the step S6, the CPU 43 which executes the subroutine by the interrupt process notifies the CPU 43, which executes the main program, of the standby distance end (S8).

In a step S9, it is determined whether the stop is due to the error. That is, it is determined whether the ASF motor 56 is stopped due to the error. The CPU 43 determines that the stop is due to the error if the error flag is "1" and determines that the stop is due to the factor other than the error if the error flag is "0". If the error flag is "1", the program is finished, and, if the stop is not due to the error (the error flag is "0"), the process progresses to a step S10.

If the standby distance end notification is received or the ASF motor 56 is stopped due to the factor other than the error, the CPU 43 drives the PF motor 58 in the step S10. That is, the driving of the PF motor 58 is permitted. For example, if the standby distance end notification is received in the step S8 and the driving of the PF motor 58 is permitted, the driving of the standby PF motor 58 starts at a time point when the ASF motor 56 which is to be driven first is driven by the standby distance w. As a result, at the time of satisfying the both-nip condition, the previous sheet P1 is transported in a state in which the looseness is slightly given. Accordingly, the previous sheet P1 which is being transported is not excessively drawn and the previous sheet P1 can be prevented from being torn or from being excessively grown.

Meanwhile, when it is determined that the ASF motor 56 stands by in the motor cooperation control condition of the step S1, the following steps S11 to S17 are performed. While the steps S4 to S10 are performed when the PF motor 58 stands by, the steps S11 to S17 are performed when the ASF motor 56 stands by. The same process as the steps S4 to S10 is performed except that the driving sequences of the ASF motor 56 and the PF motor 58 are changed.

In more detail, first, in the step S11, standby end position=PF driving start position+standby distance" is set as the standby end position. For example, when the interpage control condition is satisfied, standby end position=PF driving start position+standby distance $L_{gap}$ is set. Here, the PF driving start position is the driving start position of the PF motor 58 and the PF counter 67 for managing the driving position of the PF motor 58 as the count value is reset to "0" before the motor driving start. Since the PF driving start position has a value excluding "0" in a case where the PF counter 67 is not reset before the motor driving start, the standby end position becomes the PF driving start position (≠0) plus the standby distance w.

In a step S12, the PF motor 58 is driven. That is, the driving of the PF motor 58 which is to be driven first starts.

In a step S13, it is determined whether the current position reaches the standby end position (current position≧standby end position is satisfied). That is, it is determined whether the current position indicated by the count value of the PF counter 67 reaches the standby end position. If current position≧standby end position is satisfied, the process progresses to a step S15, and, if current position≧standby end position is not satisfied, the process progresses to a step S14.

In the step S14, it is determined whether the PF motor 58 is stopped. The case where the PF motor 58 is stopped indicates that the PF motor 58 is stopped even when current position≧standby end position is not satisfied. The stop of the PF motor 58 includes a stop due to an error and a stop due to a factor other than the error. In the stop due to the error, the CPU 43 sets an error flag to "1". Accordingly, the CPU 43 can determine whether the stop of the PF motor 58 is the stop due to the error or due to the factor other than the error, by the error flag.

Before the current position of the sheet reaches the standby end position, the steps S13 and S14 are repeatedly performed until current position≧standby end position is satisfied in the step 13, if it is not determined to the stop of the PF motor 58 in the step S14.

In the step S15, standby distance end notification is performed. In more detail, the flowchart shown in FIG. 6 includes a main program executed by the CPU 43 and a subroutine executed by an interrupt process. As described above, similar to the steps S6, S7 and S8, the steps S13, S14 and S15 correspond to the interrupt process. Accordingly, the CPU 43 performs the step S13 of determining whether current position≧standby end position is satisfied or the step S14 of determining whether the PF motor 56 is stopped. If it is determined that current position≧standby end position is satisfied in the step S13, the CPU 43 which executes the subroutine by the interrupt process notifies the CPU 43, which executes the main program, of the standby distance end (S15).

In a step S16, it is determined whether the stop is due to the error. That is, it is determined whether the PF motor 58 is stopped due to the error. The CPU 43 determines that the stop is due to the error if the error flag is "1" and determines that the stop is due to the factor other than the error if the error flag is "0". If the error flag is "1", the program is finished, and, if the stop is not due to the error (the error flag is "0"), the process progresses to a step S10.

If the standby distance end notification is received or the PF motor 58 is stopped due to the factor other than the error, the CPU 43 drives the ASF motor 56 in the step S17. That is, the driving of the ASF motor 56 is permitted.

For example, the transported operation is determined such that the PF motor 58 stands by if the both-nip condition (Nx<Ng) in which the current position Nx is ahead of the interpage control position Ng is satisfied. That is, the ASF motor 56 is determined to the motor which is to be driven first and the PF motor 58 is determined to the motor which is to be subsequently driven. As shown in FIG. 7, the ASF motor 56 is to be driven first, the pulse edges of the pulse from the encoder 61 for detecting the rotation of the ASF motor 56 is counted, and the ASF counter 66 counts the count value corresponding to the rotation driving amount of the ASF motor 56 and corresponding to the transporting distance of the sheet transported by the feeding roller 22.

As shown in FIG. 7, when the previous sheet is transported by the standby distance w such that the current position indicated by the count value of the ASF counter 66 reaches the standby end position (Yes, in the step S6), the driving of the PF motor 58 starts (S10). The ASF motor 56 is to be driven first and the PF motor 58 is driven after the standby distance w such that a portion of the sheet nipped by the feeding roller 22 is transported and looseness is slightly given to a portion of the sheet between the feeding roller 22 and the paper transporting roller 29. If the looseness of the standby distance w is slightly given, the driving of the PF motor 58 starts. Accordingly, the sheet is transported by the transporting distance a at the same speed V1 by rotating the rollers 22 and 29 while a state in which the looseness is given to the feeding roller 22 and the paper transporting roller 29 is maintained. Since the startup timings of the rollers 22 and 29 are different but the rollers 22 and 29 are transported by the same transporting distance a, the previous sheet P1 is stopped in a state in which the looseness is not given, when the transporting operation of the previous sheet P1 is finished. Accordingly, since excessive tension is not given when the previous sheet P1 is transported, the previous sheet P1 is prevented from being torn due to the excessive tension at the time of the transporting the previous sheet P1.

Meanwhile, when the sheet passes through the interpage control position Ng, the transporting operation is divided into the first transporting operation in which the previous sheet is transported from the current position to the interpage control position Ng and the second transporting operation in which the previous sheet is transported from the interpage control position Ng to the transporting end position. First, when the first transporting operation is performed, the both-nip condition (Nx<Ng) is satisfied and thus it is determined that the PF motor 58 stands by (S1). That is, the ASF motor 56 is determined to the motor which is to be driven first and the PF motor 58 is determined to the motor which is to be subsequently driven. As shown in FIG. 8, when the ASF motor 56 is to be driven first, the previous sheet is transported by the standby distance w, and the current position indicated by the count value of the ASF counter 66 reaches the standby end position (Yes, in the step S6), the driving of the PF motor 58 starts (S10). Accordingly, the previous sheet P1 is transported by the same transporting distances b1 and b2(=b1) at the same speed V2 by rotating the rollers 22 and 29 while a state in which looseness is given to the feeding roller 22 and the paper transporting roller 29 is maintained. Accordingly, since the excessive tension is not given when the previous sheet P1 is transported, the previous sheet P1 is prevented from being torn.

When the first transporting operation is finished, the second transporting operation starts. When the second transporting operation starts, the interpage control condition Nx=Ng in which the current position is identical to the interpage control position Ng is satisfied, it is determined that the ASF motor 56 stands by (S1). That is, the PF motor 58 is determined to the motor which is to be driven first and the ASF motor 56 is determined to the motor which is to be subsequently driven. As shown in FIG. 8, when the PF motor 58 is to be driven first, the previous sheet is transported by the standby distance $L_{gap}$, and the current position indicated by the count value of the PF counter 67 reaches the standby end position (Yes, in the step S13), the driving of the ASF motor 56 starts (S17). Accordingly, the predetermined distance $L_{gap}$ between the previous sheet P1 and the next sheet P2 is ensured. Accordingly, since the previous sheet P1 and the next sheet P2 are prevented from being double transported and the front end of the next sheet P2 can be detected by the paper detection sensor 33, the next sheet P2 can be set with certainty. The transporting operation in which the sheet passes through the interpage control position Ng occurs at the time of the feeding operation and the ejecting operation as well as the paper transporting operation.

Meanwhile, when the sheet is jammed in the paper transporting roller 29, that is, a paper jam occurs, an error is detected. That is, although the ASF motor 56 and the PF motor 58 are driven, the pulse is received from any one of the encoder 62 and 62 and the counts of the ASF counter 66 or the PF counter 67 are not performed. Accordingly, an error is detected. When the error is detected, the error flag is set to "1" and at the same time the driving of the ASF motor 56 or the PF motor 58 which is to be driven first is stopped at the time of detecting the error.

For example, when the driving is stopped due to the error before the ASF motor 56 reaches the standby end position (Yes, in the step S7), the driving of the PF motor 58 is not permitted. In contrast, when the driving is stopped due to the factor other than the error before the ASF motor 56 which is to be driven first is driven by the standby distance w (No, in the step S9), the driving of the PF motor 58 is permitted (S10). This is because hanging may occurs when the driving of the PF motor 58 is stopped. In this case, since the ASF motor 56 is stopped before reaching the standby distance, the PF motor 58 is driven by the distance according to the transporting distance where the driving is stopped.

For example, when the driving is stopped due to the error before the PF motor 58 reaches the standby end position (Yes, in the step S14), the driving of the ASF motor 56 is not permitted. In contrast, when the driving is stopped due to the factor other than the error before the PF motor 58 which is to be driven first is driven by the standby distance $L_{gap}$ (No, in the step S16), the driving of the ASF motor 56 is permitted (S17). This is because hanging may occur when the driving of the ASF motor 56 is stopped. In this case, since the PF motor 58 is stopped before reaching the standby distance, the ASF motor 56 is driven by the distance according to the transporting distance where the driving is stopped.

An example in which the PF motor 58 is stopped due to the factor other than the error is as follows. In the printer 11 according to the present embodiment, the driving of the motor pauses when the rear end of the sheet passes through the lever 31 of the paper detection sensor 33 and the paper detection sensor 33 is switched from on to off. This is because a residual transporting amount of the sheet is managed by another counter (override counter) after the rear end of the sheet passes through the lever 31, the sheet is not detected, and this counter is accurately reset when the paper detection sensor 33 is switched from on to off. In such a printer 11, when the length of the sheet set by the printer driver is A4 size and a user stores an A5-size sheet, the PF motor 58 may be stopped due to the factor other than the error before reaching the standby end position.

In this case, since the sheet length $P_{size}$ acquired from the header of the printing data is the A4 size, the interpage control position Ng(=$P_{size}$−(La+Lb+Lc−Ld)) is set with as a large value as a difference between the A4 size and the A5 size, compared with the interpage control position Ng set in a case of the A5-size sheet stored actually. Accordingly, before the current position Nx reaches the interpage control position Ng for the A4 size, the rear end of the A5-size sheet stored actually passes through the lever 31 such that the paper detection sensor 33 is switched from on to off. As a result, the driving of the PF motor 58 is stopped before the current position Nx reaches the standby end position. In this case, the driving of the ASF motor 56 is permitted when the PF motor 58 is driven to the standby end position, but the driving of the ASF motor 56 is permitted when the driving of the PF motor 58 is stopped due to the factor other than the error. If the driving of the ASF motor 56 is not permitted, the ASF motor 56 waits for the permission of the driving in a state in which the rear end of the previous sheet is transported to a position for passing through the lever 31 and is stopped. Thus, hanging occurs. However, in the present embodiment, when the PF motor 58 is stopped due to the factor other than the error before reaching the standby end position, the driving of the ASF motor 56 is permitted. Accordingly, in this case, with respect to the previous sheet P1 which is transported to the position where the rear end of the previous sheet P1 passes through the lever 31 and is stopped, the next sheet P2 is fed until the distance between the previous sheet P1 and the next sheet P2 becomes $L_{gap}$. At this time, the transporting distance of the ASF motor 56 is changed to a necessary value in order to ensure the gap $L_{gap}$ between the previous sheet P1 and the next sheet P2 and the ASF motor 56 of which the driving is permitted is driven by the driving amount according to the transporting distance after the change.

As described above, according to the present embodiment, the following effects can be obtained.

(1) One motor which is to be driven first is determined from the ASF motor 56 and the PF motor 58 according to a condition, the motor is driven, and the other motor is permitted when the count value (position parameter) of the counter according to the driving amount of the one motor reaches the standby end position determined by the standby distance. Accordingly, even when any one of the motors is driven according to the condition, the control contents are identical except that the driving sequences of the ASF motor 56 and the PF motor 58, both of which are objects to be controlled, are changed (the left steps S4 to S10 and the right steps S11 to S17 in the flowchart shown in FIG. 6 are symmetrical). Accordingly, it is possible to easily prepare the program of the sheet transporting control process and to provide simple control contents (program).

The two motors 56 and 58 are driven at proper startup timings. When the two transporting rollers for transporting a sheet are driven by the respective motors or when two transporting rollers for separately transporting two sheets are driven by the respective motors while a sheet gap, it is possible to suitably transport the sheet.

(2) Since a motor which is to be subsequently driven as well as a motor which is to be driven first determines the standby distance waiting for a time when the motor which is to be driven first is driven by the standby distance according to a given condition, it is possible to perform a cooperation control in which the startup timings according to the condition are deviated from each other by a predetermined distance (driving amount).

(3) When the transporting condition satisfies the both-nip condition (Nx<Ng), the ASF motor 56 is determined to the motor which is to be driven first and the PF motor 58 is determined to the motor which is to be subsequently driven. The value w for slightly giving looseness to the sheet which is being transported is set as the standby distance. Accordingly, since the looseness is given to the sheet when the previous sheet is transported, it is possible to prevent the sheet which is being transported from be excessively drawn between the feeding roller 22 and the paper transporting roller 29. Accordingly, it is prevent the sheet from being torn or stretched before printing and to perform suitable printing.

(4) Since the transporting distances (moving amount in the vicinities of the rollers) of the previous sheet transported by the feeding roller 22 and the paper transporting roller 29 at the time of satisfying the both-nip condition are identical, the previous sheet is held in a state in which looseness is low after the transporting operation is finished. Accordingly, when the transport of the next sheet starts, it is possible to prevent a paper jam due to the looseness of the sheet.

(5) When the transporting operation satisfies the interpage control condition in which the sheet passes through the interpage control position Ng, the transporting operation is divided into the first transporting operation in which the previous sheet is transported from the current position to the interpage control position Ng and the second transporting operation in which the sheet is transported from the interpage control position Ng to the transport end position. When the first transporting operation is performed, the ASF motor 56 is determined to the motor which is to be driven first, the PF motor is determined to the motor which is to be subsequently driven, and the standby distance is set to w. Since the ASF motor 56 is to be driven first and the driving of the PF motor 58 starts at a time point when the ASF motor 56 is driven to the standby end position determined by the standby distance w, the first transporting operation is performed in a state in which looseness is slightly given to the previous sheet and the previous sheet which is being transported can be prevented from being torn.

When the second transporting operation is performed subsequent to the first transporting operation, the PF motor 58 is determined to the motor which is to be driven first, the ASF motor 56 is determined to the motor which is to be subsequently driven, and the standby distance is set to $L_{gap}$. Since the PF motor 58 is to be driven first and the driving of the ASF motor 56 starts at a time point when the PF motor 58 is driven to the standby end position determined by the standby distance $L_{gap}$, the predetermined distance $L_{gap}$ between the previous sheet P1 and the next sheet P2 can be ensured.

(6) When the ASF motor 56 and the PF motor 58 are simultaneously driven, the standby distance is set to "0". Accordingly, when any one of the ASF motor 56 and the PF motor 58 is to be driven first, a standby distance for setting a difference in startup timing is set to "0" such that the ASF motor 56 and the PF motor 59 can be controlled to be simultaneously driven. Accordingly, it is possible to control to simultaneously drive two motors by changing the setting of the standby distance which is one of the setting contents, using control contents for performing the determination of a standby (subsequently driven) motor (that is, the determination of the motor which is to be driven first) and the setting of the standby distance.

(7) When the motor which is to be driven first is stopped due to the factor other than the error before reaching the standby end position, the driving of the motor which is to be subsequently driven starts. Accordingly, when the motor which is to be driven first is stopped due to the factor other than the error (that is, in a normal case), the standby motor which is to be subsequently driven is prevented from being hanged.

(8) When the motor which is to be driven first is stopped due to the error before the standby end position, the motor which is to be subsequently driven is not driven. Accordingly, at the time of the stop due to the error, it is possible to prevent the motor which is to be subsequently driven from being driven.

The invention is not limited to the above-described embodiment and the following examples may be employed.

Modified Example 1

Although the interpage control position is set to a downstream position G of a nip point between the feeding roller 22 and the retardation roller 24 in the feeding direction in the present embodiment, the interpage control position is not limited to this. The upstream side of the detection position of the sheet detection sensor 33 in the transporting direction is sufficient as The downstream position of the nip point in the feeding direction. When the interpage control position is set with a position in a range between the nip point of the feeding roller and the detection position, the interpage control is performed until the front end of the subsequent sheet is transported to the detection position such that the gap $L_{gap}$ can be ensured.

Modified Example 2

Although the acceleration/deceleration table is employed in the present embodiment, the acceleration/deceleration table may not be employed. The acceleration and the deceleration may be set by a straight line gradient such that a time per a distance (speed) in an acceleration range and a deceleration range may be obtained using a computation using a linear equation. In at least one of the acceleration range and the deceleration, at least one point in which the gradient of the acceleration or the deceleration is changed may be set.

Modified Example 3

Although the two motors for respectively driving the feeding roller 22 and the paper transporting roller 29 are used in the present embodiment, the invention is not limited to this. For example, two motors for respectively driving the paper transporting roller 29 and the ejection roller 30 may be used. Two different motors necessary for controlling cooperation while interlocked with driving objects may be used.

Modified Example 4

Although the ASF motor 56 and the PF motor 58 are separately provided and the feeding roller 22 and the paper transporting roller 29 are respectively driven by the driving sources in the present embodiment, one driving source for driving the motors may be used. In this case, an electronic clutch is detached to stop the rotation of the roller or is attached to start the driving of the roller. Even in either case, the feeding roller 22 and the paper transporting roller 29 are connected and the driving of the motor which is to be subsequently driven starts when a position parameter indicating the driving amount of the motor which is to be driven first reaches a predetermined value such that a driving start timing is controlled.

Modified Example 5

In the present embodiment, the driving source is not limited to a DC motor and another motor may be used. For example, a step motor may be used. As the step motor, for example, a 2-phase excitation method, a 1-phase excitation method, a 1-2-phase excitation method, or a micro step driving (vernier driving) method may be employed. A rotator may be of a permanent magnet type (PM type), a variable reluctance type (VR type), or a hybrid type (HB type).

Modified Example 6

Although the driving control of the ASF motor and the PF motor is realized by software by allowing the CPU 43 to execute the program in the present embodiment, the invention is not limited to the method using the software. For example, the sheet transporting control process may be realized by hardware such as a control circuit (custom IC or the like) or the sheet transporting control process may be realized by a combination (cooperation) of hardware and software.

Modified Example 7

The printer is not limited to the ink jet printer. The invention is applicable to other serial printers such as a dot impact type printer. The invention is applicable to a recording apparatus which includes a line head type recording head having nozzle for recording data over the entire width of a sheet and records data on a medium while the recording head is not moved in the main scanning direction. In this case, the medium recorded by the line head is transported at a constant speed in a transporting direction and recording is performed on the medium which is being moved in the transporting direction by the line head.

Modified Example 8

Although the ink jet printer is used as the recording apparatus in the present embodiment, the invention is applicable to a liquid ejection type recording apparatus for ejecting liquid other than ink. The term "recording" is not limited to recording using printing and may include recording which is performed by ejecting liquid including a material used in, for example, a wiring pattern of a circuit and drawing the wiring pattern on a substrate as a medium. For example, a liquid ejecting apparatus (recording apparatus) for ejecting a material in which a material such as an electrode material or a color material used for manufacturing a liquid crystal display, an electroluminescence (EL) display and a surface light-emitting display is dispersed or dissolved may be employed. In this case, a predetermined pattern such as a pixel pattern or a wiring pattern is drawn on a substrate by ejecting a liquid droplet. For example, when sheet-shaped substrates are sequentially transported one by one by a transporting device and a predetermined pattern such as a wiring pattern is drawn on a transported substrate by a recording device using a liquid ejecting method, it is possible to control the transport of a substrate as a medium through a simple control.

Hereinafter, technical spirits according to the embodiment and the modified examples will be described.

(1) The recording apparatus according to claim 1 or 2, wherein a standby amount indicated by a driving amount of the driving source, which is to be driven first, indicating the startup timing of the driving source which is to be subsequently driven is set according to the condition.

(2) The recording apparatus according to the technical spirit (1), wherein the controller substantially simultaneously starts the driving of the first driving source and the second driving source when the standby amount is a setting value corresponding to zero.

(3) The recording apparatus according to the technical spirit (1) or (2), wherein the controller stops the standby of the standby driving source and starts the driving of the driving source which is to be subsequently driven when the driving source which is to be driven first is stopped due to a factor other than an error before reaching the standby end position determined by the standby amount.

(4) The recording apparatus according to any one of the technical spirits (1) to (3), wherein the controller stops the standby of the standby driving source and does not drive the standby driving source when the driving source which is to be driven first is stopped due to the error before reaching the standby end position determined by the standby amount.

(5) The recording apparatus according to any one of the technical spirits (1) to (4) and the claims, wherein the position parameter is a count value obtained by counting driving pulses of the driving source which is to be driven first. Here, the count value of the driving pulses is not limited to a count value of the pulse number and may be a count value proportional to the pulse number such as a count value of pulse edges or the like. When the count value larger than the pulse number is used, it is possible to improve precision of the startup timing of the driving source which is to be subsequently driven. According to this configuration, it is possible to control the startup timing of the (standby) driving which is to be subsequently driven, using the count value obtained by counting the driving amount of the driving source.

(6) The recording apparatus according to claim 3, wherein the controller includes a position management controller 43 which permits the driving of the standby driving source when the driving source which is to be driven first reaches the standby end position and a driving start controller 43 which starts the driving of the driving source if the driving is permitted by the position management controller. Accordingly, the position management controller permits the driving of the standby driving source (notification of driving permission) when the driving source which is to be driven first reaches the standby end position. When the driving is permitted by the position management controller, the driving start controller starts the driving of the driving source. In the embodiment, the position management controller is configured by the CPU 43 which performs S6, S8, S13 and S15 and the driving start controller is configured by the CPU 43 which performs S10 and S17.

(7) A method of transporting a medium in a recording apparatus, wherein, in the controlling of the startup timing, first starting driving of the first transporting device and controlling the startup timing of the second transporting device which is to be subsequently driven on the basis of the position parameter according to the driving amount of the first transporting device if the one transporting device which is to be driven first is the first transporting device, and first starting driving of the second transporting device and controlling the startup timing of the first transporting device which is to be subsequently driven on the basis of the position parameter according to the driving amount of the second transporting device if the one transporting device which is to be driven first is the second transporting device.

(8) The method according to the technical spirit (7), further comprising setting the standby end position indicating the driving start timing of the other driving source which is to be subsequently driven according to the condition after starting driving of the driving source which is to be driven first, wherein, in the controlling of the startup timing, driving of the driving source which is to be subsequently driven is permitted when the position parameter according to the driving amount of the driving source which is to be driven first reaches the standby end position.

What is claimed is:

1. A recording apparatus including a first transporting device which transports a medium, a second transporting device which transports the medium at a position downstream of the first transporting device in a transporting direction, and a recording device which performs recording on the medium transported by the first and second transporting devices, the recording apparatus comprising:

a controller which determines one transporting device which is to be driven first from among the first transporting device and the second transporting device according to a condition, determines the other transporting device which is to be subsequently driven and controls a startup timing of the other transporting device which is to be subsequently driven on the basis of a position parameter according to a driving amount of the one transporting device which is to be driven first, a determining device which determines whether a transporting operation by at least the first and second transporting devices has been performed as the condition, wherein the controller starts driving of the first transporting device and controls the startup timing of the second transporting device which is to be subsequently driven on the basis of the position parameter according to the driving amount of the first transporting device if the one transporting device which is to be driven first is the first transporting device, and first starts driving of the second transporting device and controls the startup timing of the first transporting device which is to be subsequently driven on the basis of the position parameter according to the driving amount of the second transporting device if the one transporting device which is to be driven first is the second transporting device, and wherein the controller determines the first transporting device as the transporting device which is to be driven first, determines the second transporting device as the transporting device which is to be subsequently driven, and starts the driving of the first transporting device when the position parameter becomes equal to a predetermined value thereby a looseness is given to the medium during the transporting operation by at least the first and second transporting devices, if the transporting operation by at least the first and second transporting devices has been performed.

2. The recording apparatus according to claim 1, further comprising:

a first driving source which drives the first transporting device; and a second driving source which drives the second transporting device, wherein the controller determines one driving source which is to be driven first from among the first and second driving sources according to a condition and controls a startup timing of the other driving source which is to be subsequently driven on the basis of a position parameter of the one driving source which is to be driven first.

3. The recording apparatus according to claim 2, wherein the controller sets a standby amount indicated by a driving amount of the one driving source, which is to be driven first, indicating the startup timing of the other driving source which is to be subsequently driven according to the condition after starting driving of the one driving source which is to be driven first, and permits driving of the other driving source which is to be subsequently driven when the position parameter becomes equal to a standby end position determined by the standby amount.

4. The recording apparatus according to claim 3, wherein the controller substantially simultaneously starts the driving of the first driving source and the second driving source when the standby amount is a setting value corresponding to zero.

5. The recording apparatus according to claim 3, wherein the controller stops the standing by of the other driving source and starts the driving of the other driving source which is to be subsequently driven when the one driving source which is to be driven first is stopped due to a factor other than an error before reaching the standby end position determined by the standby amount.

6. The recording apparatus according to claim 5, wherein the controller stops the standing by of the other driving source and does not drive the other driving source when the one driving source which is to be driven first is stopped due to an error before reaching the standby end position determined by the standby amount.

7. The recording apparatus according to claim 1, wherein:

the controller controls the driving of the first and second transporting devices such that a previous medium which is first transported is transported to at least the first and second transporting devices, the driving of the first transporting device pauses when the previous medium is transported to a predetermined position where the previous medium cannot transported by the first transporting device, and the transport of a next medium using the first transporting device starts after a gap between the previous medium and the next medium becomes of a predetermined size, and when the condition for driving the first and second transporting devices in order to increase the gap between the previous medium and the next medium is satisfied after the first transporting device has paused at the predetermined position, the second transporting device is determined as the transporting device which is the driven first such that the driving of the second transporting device starts, and the driving of the first transporting device starts when the position parameter according to the driving amount of the second transporting device reaches a value corresponding to the gap.

8. A method of transporting a medium in a recording apparatus including a first transporting device which transports a medium, a second transporting device which transports the medium transported by the first transporting device, and a recording device which performs recording on the medium transported by the second transporting device, the method comprising:

first determining one transporting device which is to be driven first from among the first and second transporting devices according to a condition;

determining whether a transporting operation by at least the first and second transporting devices has been performed as the condition; and controlling a startup timing of the other transporting device which is to be subsequently driven, on the basis of a position parameter according to a driving amount of the one transporting device which is to be driven first from among the first and second transporting devices, wherein, in the controlling of the startup timing, first starting driving of the first transporting device and controlling the startup timing of the second transporting device which is to be subsequently driven on the basis of the position parameter according to the driving amount of the first transporting device if the one transporting device which is to be driven first is the first transporting device, and first starting driving of the second transporting device and controlling the startup timing of the first transporting device which is to be subsequently driven on the basis of the position parameter according to the driving amount of the second transporting device if the one transporting device which is to be driven first is the second transporting; and wherein, in the controlling of the startup timing, determining the first transporting device as the transporting device which is to be driven first, determining the second transporting device as the transporting device which is to be subsequently driven, and starting the driving of the first transporting device when the position parameter becomes equal to a predetermined value thereby giving a looseness to the medium during the transporting operation by at least the first and second transporting devices, if the transporting operation by at least the first and second transporting devices has been performed.

* * * * *